US009895880B2

(12) United States Patent
Hirabayashi

(10) Patent No.: US 9,895,880 B2
(45) Date of Patent: Feb. 20, 2018

(54) METHOD FOR ADJUSTING RECORDING HEAD, AND IMAGE FORMING APPARATUS

(71) Applicant: FUJIFILM Corporation, Tokyo (JP)

(72) Inventor: Yasutoshi Hirabayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/439,958

(22) Filed: Feb. 23, 2017

(65) Prior Publication Data

US 2017/0246865 A1 Aug. 31, 2017

(30) Foreign Application Priority Data

Feb. 26, 2016 (JP) ..... 2016-035841

(51) Int. Cl.
*B41J 29/38* (2006.01)
*B41J 2/045* (2006.01)
*B41J 2/155* (2006.01)

(52) U.S. Cl.
CPC ..... *B41J 2/04573* (2013.01); *B41J 2/04505* (2013.01); *B41J 2/04586* (2013.01); *B41J 2/155* (2013.01)

(58) Field of Classification Search
CPC ..... B41J 2202/20; B41J 2/04541; B41J 2/04505; B41J 2/04573; B41J 2/04543; B41J 2/04586; B41J 2/155; B41J 2/2135; B41J 2/2146; B41J 29/393; B41J 2202/21; B41J 29/38
USPC ..... 347/9, 12–14, 19, 40, 42, 49, 57, 68
See application file for complete search history.

(56) References Cited

U.S. PATENT DOCUMENTS 7,114,792 B2 10/2006 Kawauchi et al.
7,213,900 B2 * 5/2007 Ebihara ..... B41J 29/393 347/19
7,871,145 B1 * 1/2011 Enge ..... B41J 2/2135 347/14

(Continued)

FOREIGN PATENT DOCUMENTS

JP 2004268452 9/2004
JP 2011168023 9/2011

(Continued)

OTHER PUBLICATIONS

"Search Report of Europe Counterpart Application", dated Aug. 21, 2017, p. 1-p. 7.

*Primary Examiner* — Jannelle M Lebron
(74) *Attorney, Agent, or Firm* — JCIPRNET

(57) ABSTRACT

When discharge timing of a first head module and a second head module, adjacent to each other, is adjusted in a recording head in which a plurality of head modules each having s nozzle array in which a plurality of nozzles is arranged in different positions in a first direction is joined in a second direction intersecting with the first direction, the discharge timing is adjusted so that a complementary region recording shift amount being a recording shift amount in the first direction in a complementary region in a joined portion between the first head module and the second head module becomes a value between a first non-complementary region recording shift amount and a second non-complementary region recording shift amount that are recording shift amounts in the first direction in respective non-complementary regions in the first head module and the second head module.

14 Claims, 17 Drawing Sheets

(56) References Cited

U.S. PATENT DOCUMENTS

| | | | | |
|---|---|---|---|---|
| 8,523,308 | B2 | 9/2013 | Shibata et al. | |
| 2009/0051717 | A1 * | 2/2009 | Kuwahara | B41J 2/155 347/9 |

FOREIGN PATENT DOCUMENTS

| | | |
|---|---|---|
| JP | 2012076301 | 4/2012 |
| JP | 2014136319 | 7/2014 |

* cited by examiner

METHOD FOR ADJUSTING RECORDING HEAD, AND IMAGE FORMING APPARATUS

CROSS-REFERENCE TO RELATED APPLICATIONS

The present application claims priority under 35 U.S.C. §119 to Japanese Patent Application No. 2016-035841, filed on Feb. 26, 2016. The above application is hereby expressly incorporated by reference, in its entirety, into the present application.

BACKGROUND OF THE INVENTION

Field of the Invention

The present invention relates to a method for adjusting a recording head, and an image forming apparatus, and more particularly to a technique of adjusting discharge timing of an adjacent head module in a recording head formed by joining a plurality of head modules each of which is provided with a plurality of nozzles for discharging droplets.

Description of the Related Art

There is known a form using a line head formed by joining a plurality of head modules, as a recording head of an ink jet recorder as a form of an image forming apparatus. Japanese Patent Application Laid-Open No. 2014-136319 (Patent Literature 1) discloses a method of calculating a shift amount of an initial recording position in a Y-direction between a first head module and a second head module adjacent to each other. The Y-direction is a direction parallel to a paper sheet feeding direction.

In Patent Literature 1, a plurality of test patterns each with a different shift amount is recorded while a shift amount of a recording position in the Y-direction between the first head module and the second head module is changed, and concentration of a portion recorded by a recording element in a complementary region of the first head module and the second head module is acquired from readout data on the test patterns, and then a shift amount of an initial recording position in the Y-direction between the first head module and the second head module is calculated from a relationship between a shift amount and concentration. The "first head module" and the "second head module" in Patent Literature 1 are terms corresponding to a "first head module" and a "second head module" of the present specification, respectively.

Japanese Patent Application Laid-Open No. 2004-268452 (Patent Literature 2) describes a technique in which a shift amount of a printed letter between unit recording heads and that between recording heads in a paper sheet feeding direction is detected by reading an image for alignment adjustment to control ink injection timing so that a shift amount of a printed letter decreases. The "unit recording head" in Patent Literature 2 is a term corresponding to the "head module" of the present specification. The "shift amount of a printed letter" in Patent Literature 2 is a term corresponding to a "recording shift amount" in the present specification. The "ink injection timing" in Patent Literature 2 is a term corresponding to "discharge timing" of the present specification.

In addition, Japanese Patent Application Laid-Open No. 2011-168023 (Patent Literature 3) describes a technique in which drive timing is adjusted by outputting a predetermined test pattern to adjust a relative deposit position error being an amount of a level difference between sub heads by using an external reading device in a recording head formed by joining two or more sub heads. The "sub head" in Patent Literature 3 is a term corresponding to the "head module" of the present specification. The "relative deposit position error" in Patent Literature 3 is a term corresponding to the "recording shift amount" in the present specification. The "drive timing" in Patent Literature 3 is a term corresponding to the "discharge timing" of the present specification.

SUMMARY OF THE INVENTION

Conventional methods shown in Patent Literatures 1 to 3 are configured to adjust discharge timing of each of head modules so that a shift, in a Y-direction, of a deposition position of a droplet discharged from each of the head modules becomes minimum, in a complementary region that is a joined portion between the head modules adjacent to each other. A term complementary region may be understood by substituting an "overlapping region" for the term. An "overlapping portion between sub heads" in Patent Literature 2 is a term corresponding to the "complementary region".

Unfortunately, any of the methods shown in Patent Literatures 1 to 3 is not in consideration of a shift of a deposition position in a non-complementary region, the shift occurring by influence of nozzle arrangement of a two-dimensional matrix in a head module. The non-complementary region is a region other than the complementary region in the nozzle array of the head module. The term "non-complementary region" can be understood by substituting "non-overlapping region" for the term.

In a case of a recording head including a plurality of nozzles arranged in a two-dimensional matrix shape, a difference in deposition timing in a paper sheet feeding direction may occur even in a non-complementary region in the same head module due to a difference between a paper sheet feeding speed and a discharge cycle, or a difference in a throw distance for each of nozzle arrays in a nozzle face, the nozzle arrays being different in a Y-direction position, because positions of respective nozzles are away from each other in a paper sheet feeding direction. The throw distance means a distance from a nozzle to a paper sheet.

Japanese Patent Application Laid-Open No. 2012-76301 (Patent Literature 4) shows a problem in which when a droplet is discharged on a recording medium that is fed while supported on a curved face such as a drum from a liquid discharge head including a nozzle array of a two-dimensional matrix, a shift of a deposition position occurs in a paper sheet feeding direction to deteriorate linearity of a linear image (refer to FIG. 10 of Patent Literature 4).

For this kind of problem, adjusting timing of discharge for each of nozzle arrays aligned at different positions in a paper sheet feeding direction enables a shift of a deposition position to be corrected. However, there is a problem in which a complex control system is required to control discharge timing for each of the nozzle arrays different in position in a paper sheet feeding direction, thereby increasing cost, or in which it takes long time to adjust discharge timing for each of the nozzle arrays.

As another method of adjusting discharge timing of nozzle arrays aligned at different positions in the paper sheet feeding direction, adjusting a discharge cycle of a recording head enables difference in deposition timing to be reduced to a minimum. In a case of an image forming apparatus with structure in which a plurality of line heads provided for respective ink colors is arranged in a row, such as a device form that forms a color image by combining inks of a plurality of colors such as cyan, magenta, yellow, and black, a discharge cycle needs to be identical in each line head because a discharge cycle different for each of the colors varies image length for each of the colors.

Under constraints where a discharge cycle of each of a plurality of line heads is to be identical, if deposition timing is different for each of the line heads due to an attachment error of the line heads, for example, deposition timing of all of the line heads cannot be optimized. Specifically, as an example of an attachment error of the line heads, it is conceived that an inclination of the line head with respect to a paper sheet feeding direction caused by turning in a θx-direction causes a throw distance on a near side in a paper sheet feeding direction and that on a far side therein to be different from each other, for example. The turning in the θx-direction indicates turning around a rotation shaft parallel to an X-direction. The X-direction indicates a paper sheet width direction orthogonal to the Y-direction.

In a state where difference in deposition timing occurs in a non-overlapping region of the line head as described above, if discharge timing between the head modules is adjusted to a state where a shift of a deposition position becomes a minimum in a complementary region between head modules adjacent to each other, as described in the methods disclosed in Patent Literatures 1 to 3, a recording shift amount is different between the complementary region where a recording shift amount is minimized due to effect of the adjustment and a non-complementary region where the effect of the adjustment is not reflected, whereby uneven concentration corresponding to the complementary region and the non-complementary region tends to easily occur.

In addition, if discharge timing is adjusted between head modules adjacent to each other so that a shift of a deposition position becomes a minimum in a complementary region while a shift of a deposition position in the Y-direction occurs at a paper feeding side nozzle and a paper ejection side nozzle in a non-complementary region in a nozzle array of the head modules, discharge timing in the non-complementary region other than the complementary region varies between the head modules adjacent to each other.

As a result, in a line head formed by arranging a plurality of head modules in a row, difference in discharge timing between each of the head modules is accumulated so that discharge timing at head modules at opposite ends becomes greatly different from each other, thereby causing a problem in which squareness of an image varies.

The squareness of an image is one of indexes indicating drawing performance when a straight line in a direction parallel to the X-direction is recorded. While it is desirable that ideally a straight line parallel to the X-direction orthogonal to the Y-direction can be recorded, a straight line recorded actually is not a straight line parallel to the X-direction, and thus squareness of the straight line with respect to the Y-direction may vary, or linearity may deteriorate. To achieve favorable recording, it is desirable to eliminate deviation of squareness of an image as far as possible.

The present invention is made in light of the above-mentioned circumstances, and an object thereof is to provide a method for adjusting a recording head, and an image forming apparatus, capable of solving at least one of the plurality of problems described above and achieving favorable recording by reducing at least one of occurrence of uneven concentration and deviation of image squareness.

A method for adjusting a recording head of a first aspect according to a viewpoint of the present disclosure is a method for adjusting discharge timing of a plurality of head modules in the recording head formed by joining the plurality of head modules each of which has a nozzle array in which a plurality of nozzles for discharging droplets are arranged at different positions in a first direction, wherein the plurality of head modules are joined in a second direction intersecting with the first direction, the recording head including a complementary region where a nozzle belonging to one of the head modules adjacent to each other in the second direction and a nozzle belonging to the other of the head modules complement each other to record a dot row aligned in the second direction. The method includes: a first measurement step of measuring a complementary region recording shift amount that is a recording shift amount in the first direction in the complementary region in a joined portion between a first head module and a second head module that are the head modules adjacent to each other, a second measurement step of measuring a first non-complementary region recording shift amount that is a recording shift amount in the first direction in a non-complementary region other than the complementary region in a nozzle array in the first head module, and a second non-complementary region recording shift amount that is a recording shift amount in the first direction in a non-complementary region other than the complementary region in a nozzle array in the second head module, and a timing adjustment step of adjusting discharge timing of at least one of the first head module and the second head module according to the complementary region recording shift amount measured in the first measurement step, and the first non-complementary region recording shift amount and the second non-complementary region recording shift amount, measured in the second measurement step, wherein adjustment is performed in the timing adjustment step so that the complementary region recording shift amount after being adjusted becomes a value between the first non-complementary region recording shift amount and the second non-complementary region recording shift amount.

The value between the first non-complementary region recording shift amount and the second non-complementary region recording shift amount is a value equal to the first non-complementary region recording shift amount and the second non-complementary region recording shift amount when the first non-complementary region recording shift amount and the second non-complementary region recording shift amount are the same value. In addition, when the first non-complementary region recording shift amount and the second non-complementary region recording shift amount are different values, the value between the first non-complementary region recording shift amount and the second non-complementary region recording shift amount is a value more than a value smaller of the first non-complementary region recording shift amount and the second non-complementary region recording shift amount, as well as less than a value larger of the first non-complementary region recording shift amount and the second non-complementary region recording shift amount.

According to the first aspect, discharge timing of adjacent head modules is adjusted so that a recording shift amount in a complementary region in a joined portion between the head modules adjacent to each other is within a range between recording shift amounts in non-complementary regions of the respective adjacent head modules. Accordingly, variation between the recording shift amount in the non-complementary region and the recording shift amount in the complementary region becomes moderate, and thus uneven concentration can be reduced.

In addition, the first aspect is less likely to cause a problem in that a difference in discharge timing between respective head modules is accumulated to reduce squareness of an image that is one of problems in a conventional method.

As a second aspect, in the method for adjusting a recording head of the first aspect, it can be configured that adjustment is performed in the timing adjustment step so that the complementary region recording shift amount after being adjusted becomes an average value of the first non-complementary region recording shift amount and the second non-complementary region recording shift amount.

Uneven concentration can be further reduced by adjusting the complementary region recording shift amount so that the amount becomes an average value of the first non-complementary region recording shift amount and the second non-complementary region recording shift amount.

As a third aspect, in the method for adjusting a recording head of the first aspect or the second aspect, it can be configured that the complementary region becomes an array form in which projection nozzles belonging to the first head module and projection nozzles belonging to the second head module are interleaved in a projected nozzle array in which the projection nozzles align along the second direction, the projection nozzles being acquired by projecting each of nozzles of the first head module and the second head module on a straight line along the second direction.

An "interleaved array form" is not limited to a form in which the projection nozzles belonging to the first head module and the projection nozzles belonging to the second head module alternately align one by one, and can be such as: a form in which two or more projection nozzles belonging to the second head module continuously align between each of the projection nozzles belonging to the first head module; a form in which two or more projection nozzles belonging to the first head module continuously align between each of the projection nozzles belonging to the second head module; and a form of an appropriate combination of the Mims described above.

As a fourth aspect, in the method for adjusting a recording head of any one of the first to third aspects, it can be configured that the first non-complementary region recording shift amount is measured at a position closer to the second head module than a center position of the first head module in the second direction in the non-complementary region of the first head module, and that the second non-complementary region recording shift amount is measured at a position closer to the first head module than a center position of the second head module in the second direction in the non-complementary region of the second head module.

It is preferable that measurement of a recording shift amount in the non-complementary region of each of the first head module and the second head module is performed at a position as close as possible to the complementary region in the joined portion between the first head module and the second head module. According to the fourth aspect, the first non-complementary region recording shift amount and the second non-complementary region recording shift amount each are measured at a position relatively close to the complementary region in the joined portion, in the non-complementary region of each of the first head module and the second head module.

As a fifth aspect, in the method for adjusting a recording head of any one of the first to fourth aspects, it can be configured to includes a first test pattern recording step of recording a first test pattern to be used to measure the complementary region recording shift amount on a recording medium with the first head module and the second head module, a second test pattern recording step of recording a second test pattern to be used to measure the first non-complementary region recording shift amount on a recording medium with the first head module and the second head module, and a third test pattern recording step of recording a third test pattern to be used to measure the second non-complementary region recording shift amount on a recording medium with the first head module and the second head module.

Each of test patterns of the first test pattern, the second test pattern, and the third test pattern, may be recorded in the same recording medium, or in a different recording medium. The complementary region recording shift amount can be measured on the basis of a recorded result of the first test pattern. The first non-complementary region recording shift amount can be measured on the basis of a recorded result of the second test pattern. The second non-complementary region recording shift amount can be measured on the basis of a recorded result of the third test pattern.

As a sixth aspect, in the method for adjusting a recording head of the fifth aspect, it can be configured that a pattern equivalent to the first test pattern is used for each of the second test pattern and the third test pattern, and that the first non-complementary region recording shift amount and the second non-complementary region recording shift amount are measured by a measurement method equivalent to a measurement method of the complementary region recording shift amount.

An "equivalent pattern" indicates that while a nozzle used for recording is different, a form of a pattern and output conditions of the pattern are similar.

As a seventh aspect, in the method for adjusting a recording head of the fifth aspect or the sixth aspect, it can be configured to include a reading step of creating readout data on each of the test patterns by reading out a recorded result of each of test patterns of the first test pattern, the second test pattern, and the third test pattern, and it can be configured that the complementary region recording shift amount, the first non-complementary region recording shift amount, and the second non-complementary region recording shift amount, are measured according to the readout data.

As an eighth aspect, in the method for adjusting a recording head of any one of the first to seventh aspects, it can be configured to include a calculation step of calculating an adjustment value of discharge timing according to the complementary region recording shift amount measured in the first measurement step, and the first non-complementary region recording shift amount and the second non-complementary region recording shift amount, measured in the second measurement step.

According to the eighth aspect, the adjustment value is calculated in the calculation step so that the complementary region recording shift amount becomes a value between the first non-complementary region recording shift amount and the second non-complementary region recording shift amount, and the discharge timing is adjusted on the basis of the calculated adjustment value.

As a ninth aspect, in the method for adjusting a recording head of any one of the first to eighth aspects, it can be configured that the first non-complementary region recording shift amount is acquired by measuring an amount of displacement of a recording position of each of nozzles as far as possible from each other in the first direction, in nozzles adjacent to each other in the second direction in a nozzle range in the second direction, with a width equivalent to a complementary region width that is a width of the complementary region in the second direction, in nozzles belonging to the non-complementary region of the first head module, and that the second non-complementary region recording shift amount is acquired by measuring an amount of displacement of a recording position of each of nozzles as far as possible from each other in the first direction, in nozzles adjacent to each other in the second direction in a nozzle range in the second direction, with a width equivalent to the complementary region width, in nozzles belonging to the non-complementary region of the second head module.

As a tenth aspect, in the method for adjusting a recording head of any one of the first to ninth aspects, it can be configured that the first direction is a feeding direction of a recording medium, and the recording head is a line head.

As a eleventh aspect, in the method for adjusting a recording head of any one of the first to tenth aspects, it can be configured that the head module includes a nozzle region where a plurality of nozzles are arranged to form a two-dimensional array, the nozzle region being in the shape of a parallelogram in plan view, and that the recording head is a line head formed by aligning the plurality of head modules each including the nozzle region in the shape of a parallelogram in plan view, in the second direction.

As a twelfth aspect, in the method for adjusting a recording head of any one of the first to eleventh aspects, it can be configured to include a feeding step of feeding a recording medium by bringing the recording medium into close contact with a curved face, and it can be configured that a droplet is discharged from the nozzle to the recording medium in close contact with the curved face.

An image forming apparatus of a thirteenth aspect according to another viewpoint of the present disclosure includes: a recording head formed by joining the plurality of head modules each of which has a nozzle array in which a plurality of nozzles for discharging droplets are arranged at different positions in a first direction, the head modules being joined in a second direction intersecting with the first direction, the recording head including a complementary region where a nozzle belonging to one of the head modules adjacent to each other in the second direction and a nozzle belonging to the other of the head modules complement each other to record a dot row aligned in the second direction; a first measurement unit that measures a complementary region recording shift amount that is a recording shift amount in the first direction in the complementary region in a joined portion between a first head module and a second head module that are the head modules adjacent to each other; a second measurement unit that measures a first non-complementary region recording shift amount that is a recording shift amount a recording shift amount in the first direction in a non-complementary region other than the complementary region in a nozzle array in the first head module, and a second non-complementary region recording shift amount that is a recording shift amount in the first direction in a non-complementary region other than the complementary region in a nozzle array in the second head module; and a timing adjustment unit that adjusts discharge timing of at least one of the first head module and the second head module according to the complementary region recording shift amount measured by the first measurement unit, and the first non-complementary region recording shift amount and the second non-complementary region recording shift amount, measured by the second measurement unit, wherein the timing adjustment unit performs adjustment so that the complementary region recording shift amount after being adjusted becomes a value between the first non-complementary region recording shift amount and the second non-complementary region recording shift amount.

As a fourteenth aspect, in the image forming apparatus of the thirteenth aspect, it can be configured that the image forming apparatus includes a plurality of recording heads.

In the image forming apparatus of the thirteenth aspect or the fourteenth aspect, a matter similar to the matters defined from the second aspect to the twelfth aspect can be appropriately combined. In that case, the steps defined in the method for adjusting a recording head can be grasped as means for performing a process or a function corresponding to the mater, a processing unit, or an element of an operation unit or the like.

According to the present invention, it is possible to achieve favorable recording by reducing at least one of occurrence of uneven concentration and deviation of squareness of an image.

DETAILED DESCRIPTION OF THE EMBODIMENTS

Hereinafter, preferable embodiments of the present invention will be described in detail with reference to accompanying drawings.

Configuration Example of Recording Head

Figure 1:
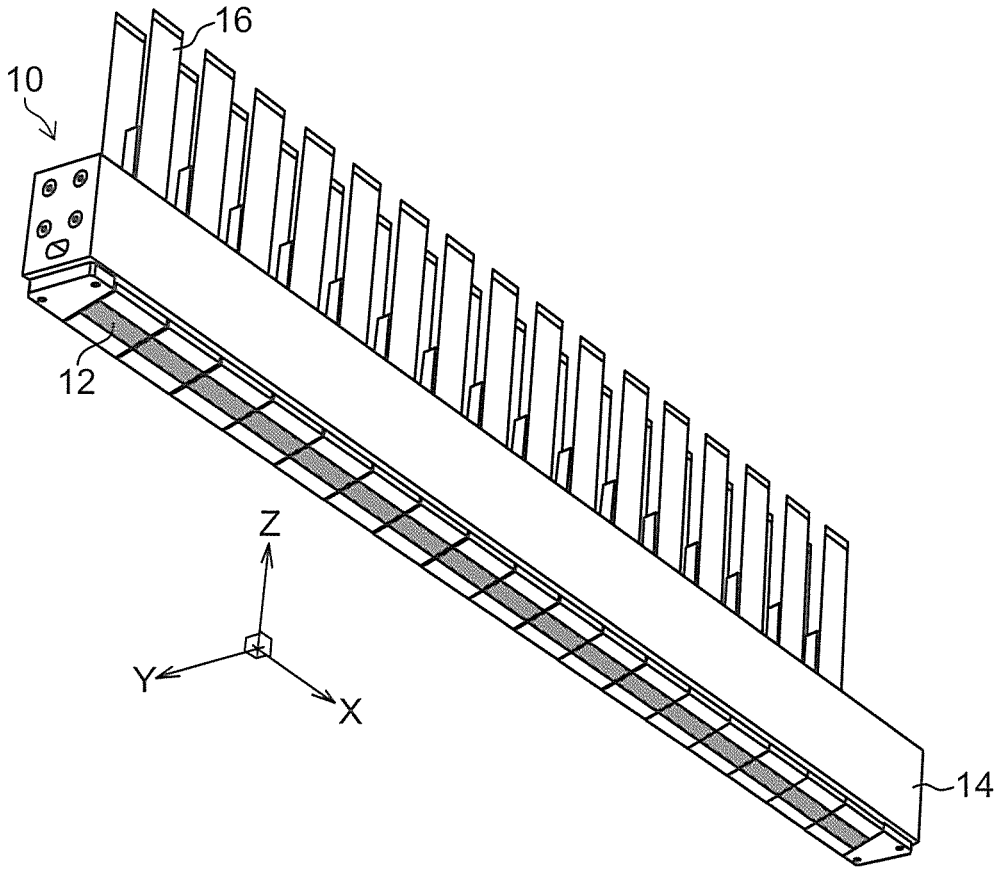
FIG. 1 is a perspective view illustrating an example of a recording head to be used for an ink jet recorder.

FIG. 1 is a perspective view illustrating an example of a recording head to be used for an ink jet recorder. FIG. 1 illustrates a state where a discharge face is viewed from an oblique downward direction of a recording head 10. A recording head 10 is formed by joining a plurality of head modules 12 in a paper sheet width direction, as a line head of an elongated strip.

The plurality of head modules 12 is fixed to a base frame 14 to form one ink jet head bar. The base frame 14 is a frame body for coupling and fixing the plurality of head modules 12 in the shape of a bar. A flexible substrate 16 is connected to each of the head module 12. The flexible substrate 16 is connected to a control device that is not illustrated in FIG. 1. While the recording head 10 illustrated in FIG. 1 is formed by joining seventeen head modules 12 arranged in a row, structure of each of the head modules 12, the number of the head modules 12, and an array form thereof, are not limited to an example illustrated. In the present specification, a paper sheet feeding direction is indicated as a Y-direction, and a paper sheet width direction orthogonal to the Y-direction is indicated as an X-direction. In addition, a direction orthogonal to the X-direction as well as the Y-direction is indicated as a Z-direction. In the present example, a paper sheet that is not illustrated in FIG. 1 is fed toward a positive direction of a Y-axis of an XYZ-orthogonal coordinates system. The recording head 10 is disposed at a position away from a recording face of the paper sheet in a positive direction of a Z-axis.

Figure 2:
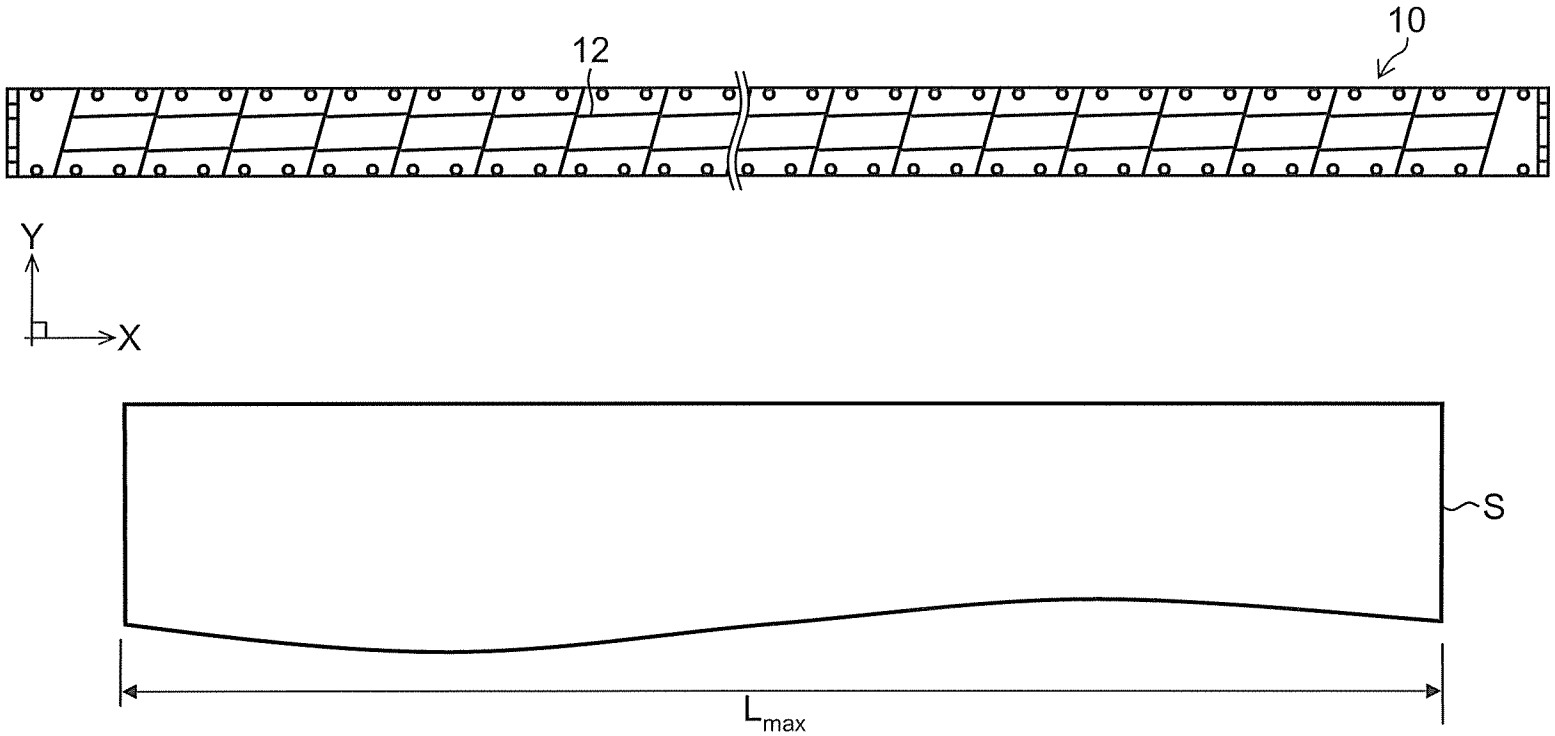
FIG. 2 is a plan view schematically illustrating a relationship between a recording head and a paper sheet.

FIG. 2 is a plan view schematically illustrating a relationship between a recording head 10 and a paper sheet S. FIG. 2 is illustrated as a perspective plan view in which the recording head 10 is viewed from above toward a negative direction of the Z-axis. The recording head 10 has structure in which a plurality of nozzle apertures is arranged in the X-direction orthogonal to the paper sheet feeding direction throughout a length exceeding the is full width $L_{max}$ of a paper sheet S. In FIG. 2, an illustration of the nozzle apertures is omitted.

The same structure may be applied to each of the plurality of head modules 12. In addition, the head module 12 may have structure that allows the head module 12 to serve alone as an ink jet head.

Configuration Example of Head Module

Figure 3:
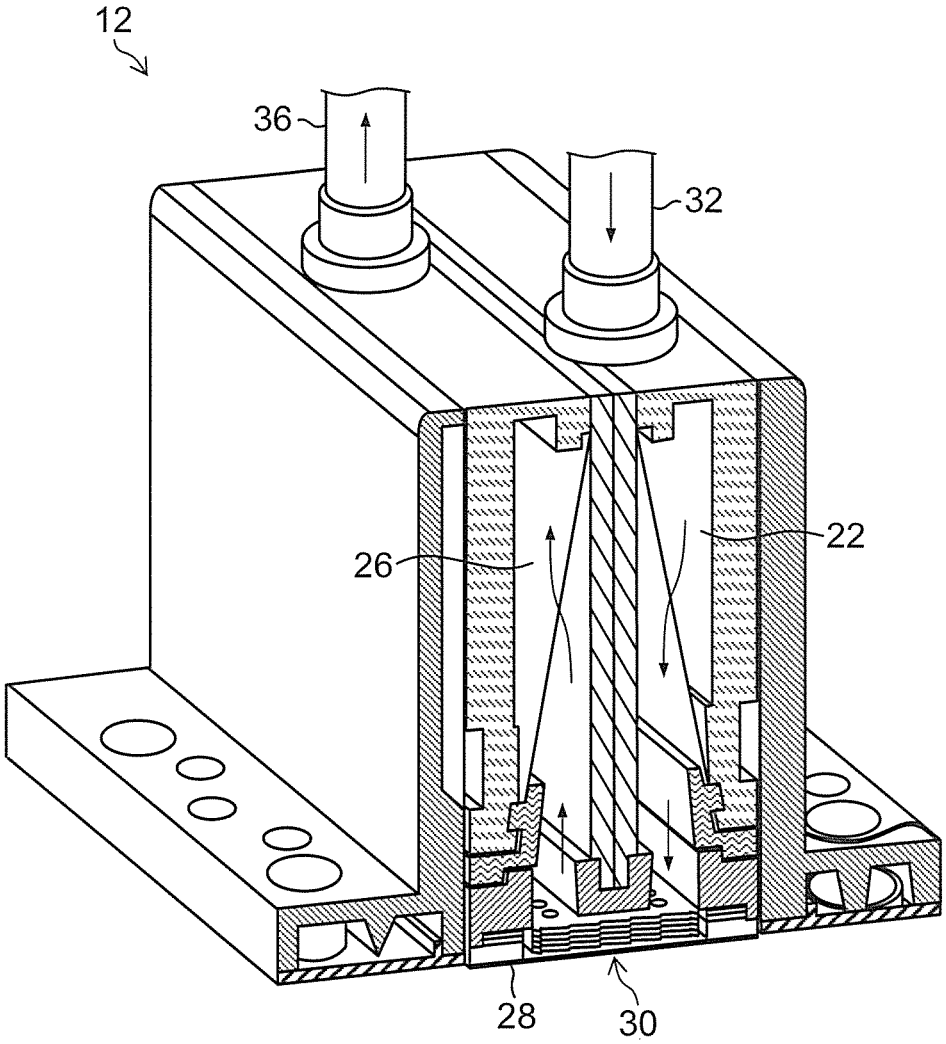
FIG. 3 is a perspective view of a head module and includes a partly-sectioned view thereof.

FIG. 3 is a perspective view of a head module 12 and includes a partly-sectioned view thereof. The head module 12 includes an ink supply chamber 22 and an ink circulate chamber 26. The ink supply chamber 22 and the ink circulate chamber 26 are disposed on a side opposite to a discharge face 30 of a nozzle plate 28. The ink supply chamber 22 is connected to an ink tank (not illustrated) through a supply line 32. The ink circulate chamber 26 is connected to a recovery tank (not illustrated) through a circulation line 36.

Figure 4:
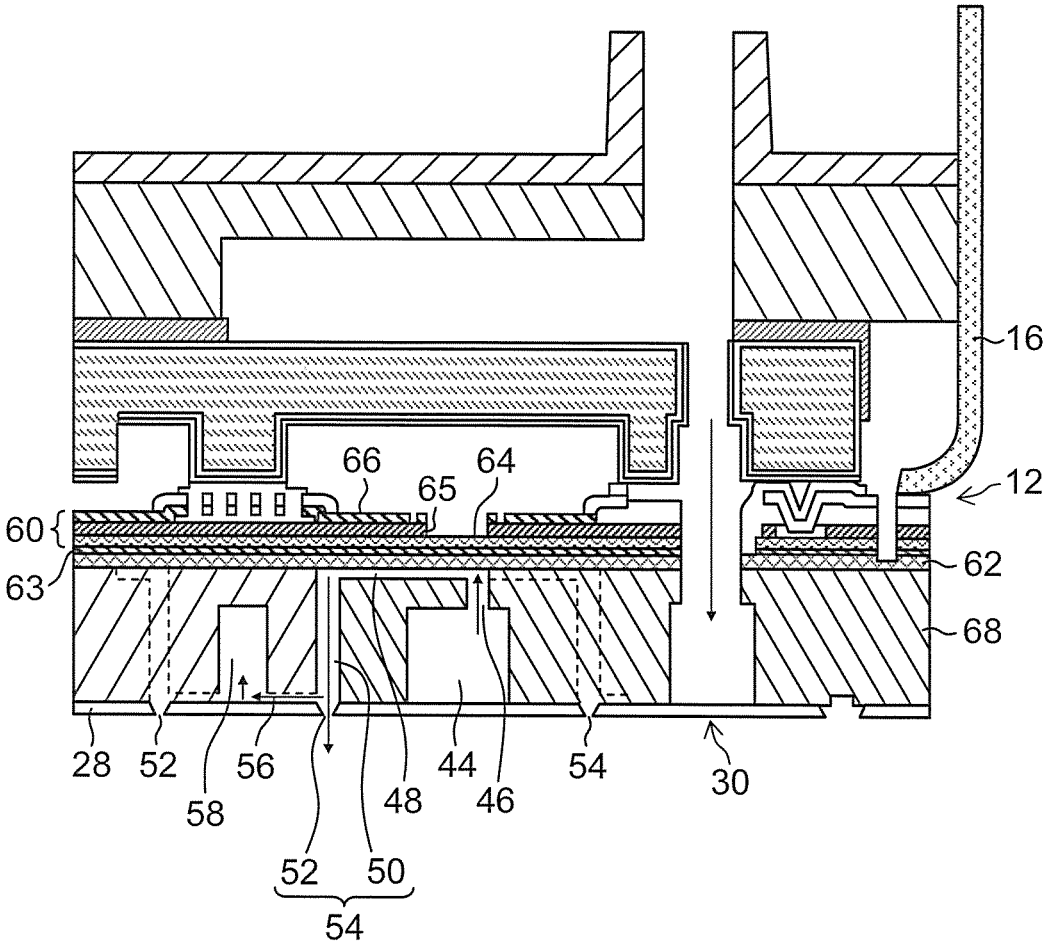
FIG. 4 is a sectional view illustrating an internal structure of the head module.

FIG. 4 is a sectional view illustrating an internal structure of the head module 12. The head module 12 includes an ink supply channel 44, an individual supply channel 46, pressure chamber 48, a nozzle communication passage 50, an nozzle aperture 52, a circulation individual flow channel 56, a circulation common flow channel 58, a piezoelectric element 60, and a vibrating plate 62.

The ink supply channel 44, the individual supply channel 46, the pressure chamber 48, the nozzle communication passage 50, the circulation individual flow channel 56, and the circulation common flow channel 58, are formed in a flow channel structure 68. The nozzle aperture 52 is formed in the nozzle plate 28. The nozzle section 54 may be formed by including the nozzle aperture 52 and the nozzle communication passage 50. The nozzle aperture 52 serving as a discharge port of a droplet may sometimes called a "nozzle". The nozzle aperture 52 corresponds to a form of the "nozzle".

The individual supply channel 46 is a flow channel connecting the pressure chamber 48 and the ink supply channel 44 to each other. The nozzle communication passage 50 is a flow channel connecting the pressure chamber 48 and the nozzle aperture 52 to each other. The circulation individual flow channel 56 is a flow channel connecting the nozzle communication passage 50 and the circulation common flow channel 58 to each other.

The vibrating plate 62 is provided on the flow channel structure 68. The piezoelectric element 60 is provided above the vibrating plate 62 through an adhesive layer 63. The piezoelectric element 60 has a laminated structure composed of a bottom electrode 64, a piezoelectric layer 65, and an upper electrode 66. The bottom electrode 64 may be sometimes called a common electrode, and the upper electrode 66 may be sometimes called an individual electrode. There is also available a form in which the bottom electrode 64 is directly deposited on the vibrating plate 62, and in this case, the adhesive layer 63 is eliminated.

The upper electrode 66 is an individual electrode that is patterned in accordance with a plan-view shape of each of the pressure chambers 48, and the piezoelectric element 60 is provided for each of the pressure chambers 48.

The ink supply channel 44 is connected to the ink supply chamber 22 illustrated in FIG. 3. Ink is supplied to the pressure chamber 48 from the ink supply channel 44 through the individual supply channel 46. When drive voltage is applied to the upper electrode 66 of the piezoelectric element 60 to be operated in accordance with image data, the piezoelectric element 60 and the vibrating plate 62 are deformed to change a volume of the pressure chamber 48.

The head module 12 can discharge a droplet of the ink from the nozzle aperture 52 through the nozzle communication passage 50 by using pressure change with change in the volume of the pressure chamber 48. In the head module 12, drive of the piezoelectric element 60 corresponding to each of the nozzle apertures 52 is controlled in accordance with dot data created from the image data.

While the paper sheet S illustrated in FIG. 2 is fed at a predetermined speed in the paper sheet feeding direction, a desired image is formed on the paper sheet S by controlling discharge timing of a droplet from each of the nozzle apertures 52 in accordance with a feeding speed of the paper sheet S.

The nozzle communication passage 50 communicates with the circulation individual flow channel 56. It is desirable that a connecting portion between the nozzle communication passage 50 and the circulation individual flow channel 56 is close to the nozzle aperture 52 in the nozzle communication passage 50. Ink that is not used for discharge in the ink supplied to the nozzle section 54 is recovered to the circulation common flow channel 58 through the circulation individual flow channel 56.

The circulation common flow channel 58 is connected to the ink circulate chamber 26 illustrated in FIG. 3. Allowing ink to be always recovered to the circulation common flow channel 58 through the circulation individual flow channel 56 prevents viscosity of the ink in the nozzle section 54 from increasing during a non-discharge period.

Figure 5:
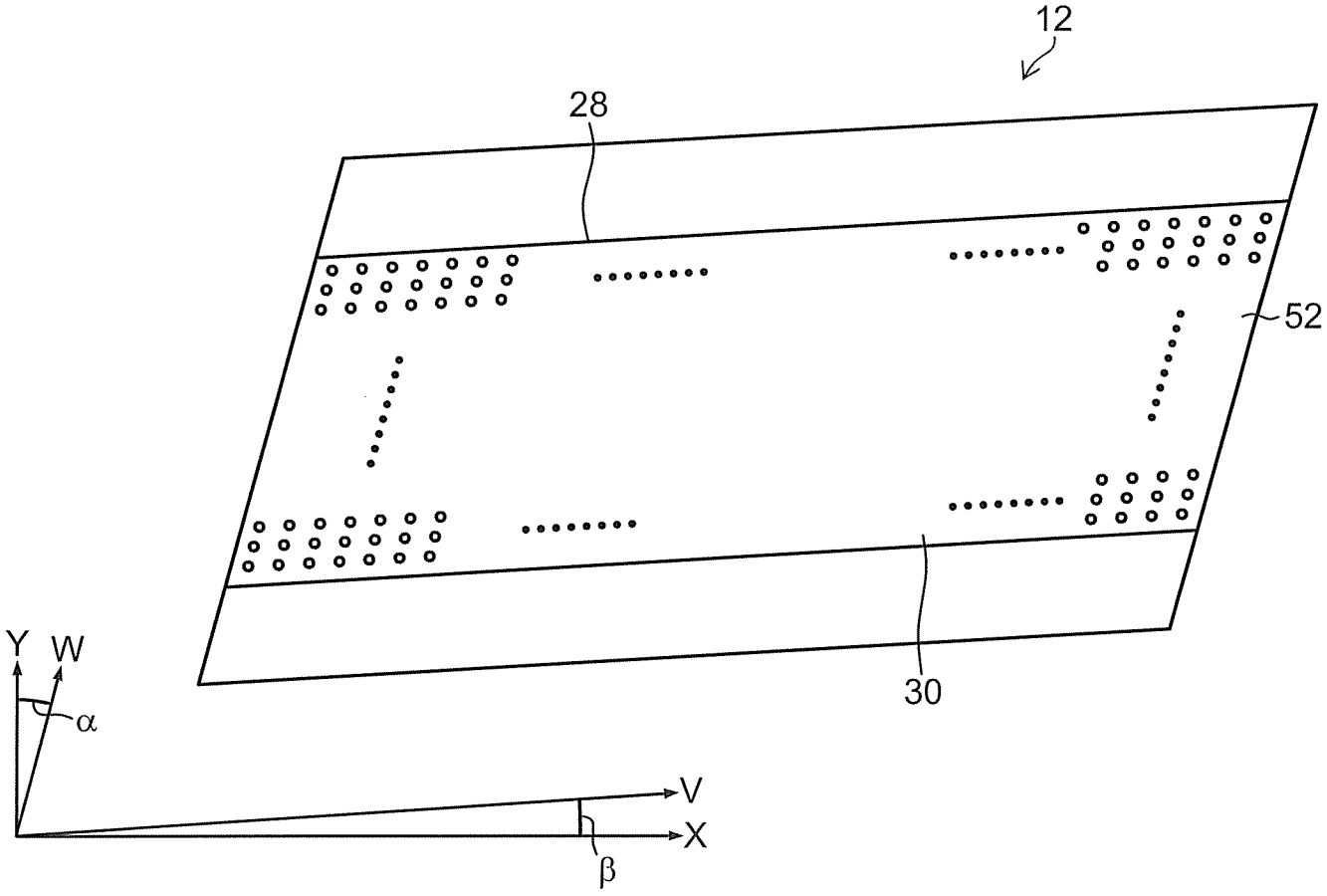
FIG. 5 is a perspective plan view of a discharge face in the head module.

FIG. 5 is a perspective plan view of the discharge face 30 in the head module 12. The plurality of nozzle apertures 52 is arranged in a two-dimensional matrix shape in the nozzle plate 28 of one head module 12. FIG. 5 is a schematic diagram in which the number of the nozzle apertures 52 is reduced for convenience of illustration, and thus only a part of the nozzle apertures 52 constituting nozzle arrangement of a two-dimensional matrix is illustrated to partially eliminate illustration of the nozzle apertures 52 of nozzle arrays.

The nozzle plate 28 of the head module 12 is formed in a plane shape of a parallelogram with end faces each on a short side along a W-direction with an inclination of an angle $\alpha$ with respect to the Y-direction, and end faces each on a long side along a V-direction with an inclination of an angle $\beta$ with respect to the X-direction. The angle $\alpha$ can be designed at an appropriate value more than 0°, and can be designed at a value satisfying the following: $0° < \alpha \leq 45°$, for example. The angle $\beta$ can be designed at an appropriate value equal to or more than 0°, and can be designed at a value satisfying the following: $0° \leq \beta < 30°$, for example.

In the discharge face 30 of the head module 12, the plurality of nozzle aperture 52 is arranged in a two-dimensional matrix shape by aligning in a row direction along the V-direction and a column direction along the W-direction. An array form of the nozzle apertures 52 is not limited to the form illustrated in FIG. 5, and various array forms are available.

In a case of a liquid discharge head with a two-dimensional nozzle array, it can be conceived that a projected nozzle array in which each of nozzle apertures in the two-dimensional nozzle array is projected (orthogonal projection) so as to align along the X-direction is equivalent to a nozzle array of a line in which the nozzles align at approximately equal intervals at nozzle density for achieving a maximum recording resolution in the X-direction. The "approximately equal interval" means that a recordable depositing point in an ink jet recorder is set at a substantially equal interval. For example, a concept of the "equal interval" includes also a case where each of intervals is slightly varied in consideration of displacement of droplets on a paper sheet due to an error in manufacturing and interference of deposition. In consideration of the projected nozzle array (also referred to as a "substantial nozzle array"), a nozzle number indicating a nozzle position can be associated with the order of alignment of the projected nozzles aligning along the X-direction.

The recording head 10 shown in the present embodiment includes a joined portion between the head modules 12 adjacent to each other in the projected nozzle array in the X-direction, where the nozzle apertures 52 belonging to one of the head modules 12, and the nozzle apertures 52 belonging to the other of the head modules 12, are mixed to achieve a required recording resolution.

Specific Example of Nozzle Array

Figure 6:
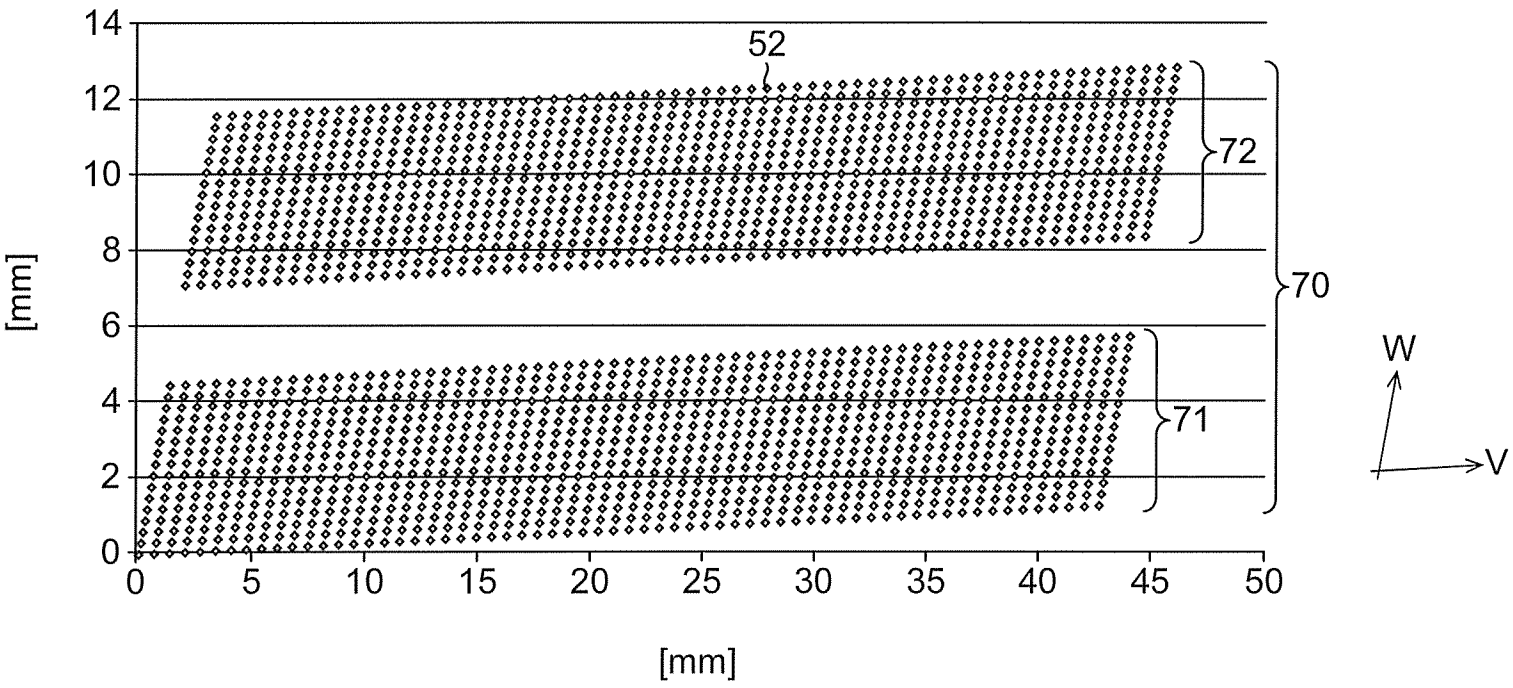
FIG. 6 illustrates an example of a nozzle array of the head module.

FIG. 6 illustrates an example of a nozzle array of the head module 12. FIG. 6 illustrates nozzle arrangement of the array of the nozzle apertures 52 formed in the nozzle plate 28, illustrated in FIGS. 4 and 5, as viewed from a pressure chamber 48 side. In FIG. 6, a horizontal axis indicates a position in the X-direction, and a vertical axis indicates a position in the Y-direction. The paper sheet S that is not illustrated in FIG. 6 is fed parallel to the vertical axis of FIG. 6 and fed upward from a lower portion in FIG. 6.

In the nozzle arrangement of a two-dimensional matrix illustrated in FIG. 6, a nozzle array direction parallel to the V-direction is called a "row direction", and a nozzle array direction parallel to the W-direction is called a "column direction". A nozzle array in which the nozzle apertures 52 align in the row direction is called a "row direction nozzle array", and a nozzle array in which the nozzle apertures 52 align in the column direction is called a "column direction nozzle array". The number of the row direction nozzle arrays aligning in the Y-direction is called a "row number", and the number of the column direction nozzle arrays aligning in the X-direction is called a "column number".

A nozzle array 70 illustrated in FIG. 6 includes a first nozzle group 71 composed of nozzle arrangement of a two-dimensional matrix of 16 rows by 64 columns, and a second nozzle group 72 composed of nozzle arrangement of a two-dimensional matrix of 16 rows by 64 columns, and the groups align away from each other in the Y-direction to form nozzle arrangement of a two-dimensional matrix of 32 rows by 64 columns as a whole. In the column direction nozzle array, a column number, such as the first column, the second column . . . the sixty fourth column, from a left end of FIG. 6, can be determined. In addition, in the row direction nozzle array, a row number, such as the first row, the second row . . . the thirty second row, from a lowermost row of FIG. 6, can be determined.

The first nozzle group 71 has matrix arrangement in which the nozzle apertures 52 align in the X-direction at a nozzle density of 600 npi. Likewise, the second nozzle group 72 has matrix arrangement in which the nozzle apertures 52 align in the X-direction at a nozzle density of 600 npi. The term "npi" means nozzles per inch, and is a unit representing the number of nozzles per inch. One inch is 25.4 millimeter (mm). Since one nozzle can record a dot of one pixel, the npi can be substituted with dpi to be understood. The term "dpi" means dots per inch, and is a unit representing the number of dots (points) per inch. Hereinafter, density of nozzle array is represented by "dpi".

The first nozzle group 71 at 600 dpi and the second nozzle group 72 at 600 dpi are combined to enable recording at 1200 dpi in the X-direction to be performed in the entire head module.

That is, when a projected nozzle array acquired by projecting each of the nozzles in the nozzle arrangement illustrated in FIG. 6 on an X-axis is viewed, nozzles belonging to the first nozzle group 71 on a paper feeding side and nozzles belonging to the second nozzle group 72 are adjacent to each other. The nozzles belonging to the first nozzle group 71 are called paper feeding side nozzles, and the nozzles belonging to the second nozzle group 72 are called paper ejection side nozzles.

Regarding Complementary Region and Non-complementary Region

As described above, the head module 12 includes a nozzle array in which a plurality of nozzles is arranged at different positions in the Y-direction. The recording head 10 formed by joining the plurality of head modules 12 in the X-direction has a complementary region in a joined portion between head modules adjacent to each other in the X-direction. The complementary region is a region where nozzles belonging to one of two head modules adjacent to each other in the X-direction and nozzles belonging to the other thereof complement each other to record a dot row aligning in the X-direction.

In the recording head 10, one of two head modules adjacent to each other in the X-direction is called a first head module, and the other thereof is called a second head module. In the complementary region, a dot row in a recording line along the X-direction is formed of a mixed array of dots to be recorded by nozzles belonging to the first head module and dots to be recorded by nozzles belonging to the second head module.

When the complementary region is viewed from a viewpoint of a projected nozzle array, it also can be grasped as follows. That is, the complementary region becomes an array form in which projection nozzles belonging to the first head module and projection nozzles belonging to the second head module are interleaved in a projection nozzle array in which the projection nozzles acquired by projecting each of nozzles of the first head module and the second head module on a straight line along the X-direction align along the X-direction. An "interleaved array form" is not limited to regularly alternate array, and includes an array in which each of the nozzles aligns at an appropriate blend ratio.

In a case of the nozzle array illustrated in FIG. 6, nozzles corresponding to the complementary region are 64 nozzles in 4 columns at each of ends in the X-direction in the nozzle array. Specifically, in a joined portion in structure where two head modules each with the nozzle array illustrated in FIG. 6 are joined side by side, nozzles corresponding to a complementary region of the head module on a left side are 64 nozzles of a total of nozzles from the twenty fifth row to the thirty second row in the sixty first column, from the seventeenth row to the thirty second row in the sixty second column, from the seventeenth row to the thirty second row in the sixty third column, and from the ninth row to the thirty second row in the sixty fourth column.

Meanwhile, in the joined portion in the structure where two head modules each with the nozzle array illustrated in FIG. 6 are joined side by side, nozzles corresponding to a complementary region of the head module on a right side are 64 nozzles of a total of nozzles from the first row to the twenty fourth row in the first column, from the first row to the sixteenth row in the second column, from the first row to the sixteenth row in the third column, and from the first row to the eighth row in the fourth column.

In addition, a region in the nozzle array of the head module 12 other than the complementary region is a non-complementary region. In a case of the nozzle array illustrated in FIG. 6, a nozzle region except 64 nozzles in 4 columns at each of ends in the X-direction, described above, corresponds to the non-complementary region. The Y-direction corresponds to a form of the "first direction", and the X-direction corresponds to a form of the "second direction".

Description of Problem

Figure 7:
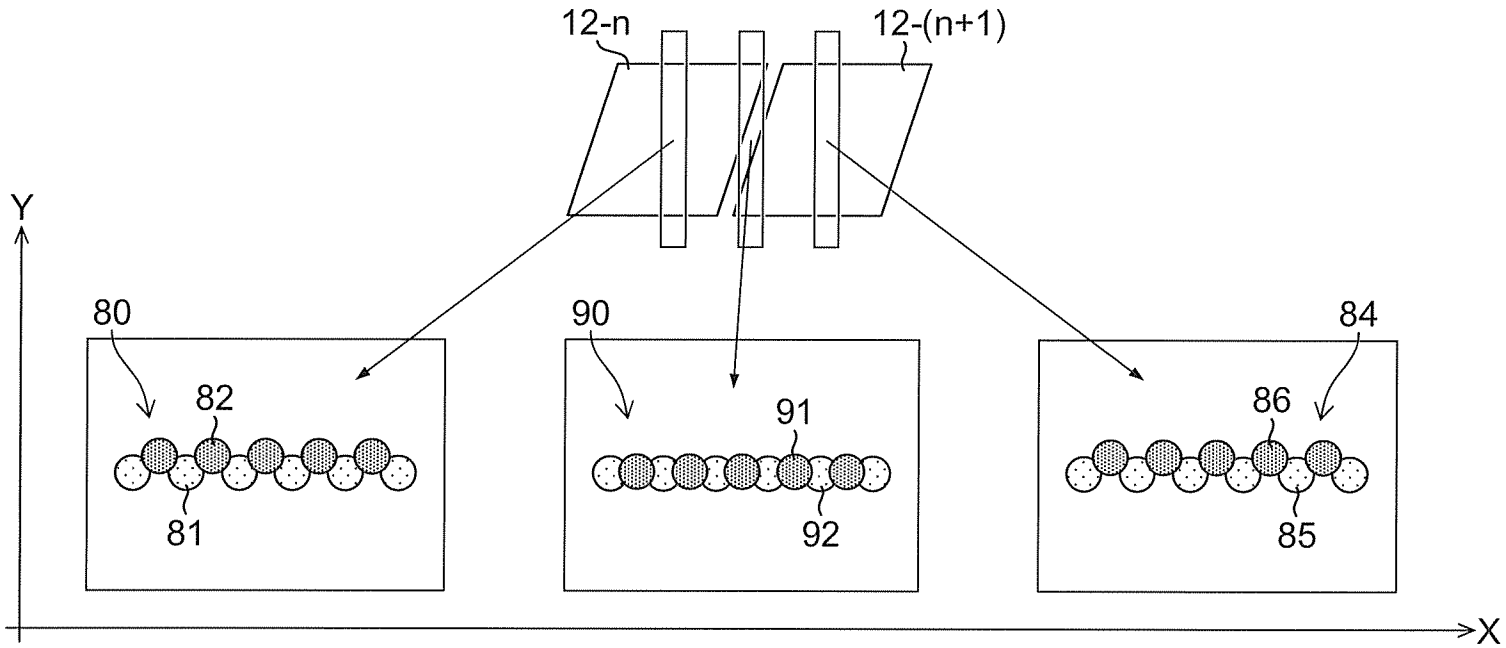
FIG. 7 illustrates images of a recording shift amount when a straight line parallel to the X-direction is recorded by a recording head with a nozzle array in which a paper feeding side nozzle and a paper ejection side nozzle are alternately aligned along an X-direction.

FIG. 7 illustrates images of a recording shift amount when a straight line parallel to the X-direction is recorded by using a recording head in which a paper feeding side nozzle and a paper ejection side nozzle are alternately used to record pixels aligning in the X-direction.

For a plurality of head modules constituting a line head, a head module number can be determined according to an alignment order of the head modules from one end in the X-direction. For example, in the recording head 10 illustrated in FIG. 2, when a head module number is determined in order from a head module at a left end, such as the first, second, and third, a head module at the right-most end is the seventeenth head module. In a case where the number of head modules constituting a line head is indicated as Nm, and an integer representing a head module number is indicated as i, Nm is an integer of 2 or more, and i is an integer not less than 1 and not more than Nm.

FIG. 7 illustrates the n-th head module 12-*n* and the (n+1)th head module 12-(*n*+1) that are head modules adjacent to each other in the X-direction, where n is an integer not less than 1 and less than Nm.

A pattern of a dot row designated by a reference numeral 80 in FIG. 7 is an example of an X-direction recording line recorded by nozzles in a non-complementary region in a nozzle array of the n-th head module 12-*n*. When the pattern 80 of a dot row aligned along the X-direction is recorded by using the nozzles in the non-complementary region in the n-th head module 12-*n*, recording shift between a paper feeding side nozzle and a paper ejection side nozzle may occur due to a difference between paper sheet feeding speed and discharge timing, a difference in a throw distance, or the like, as described above. That is, a Y-direction position of a dot 81 recorded by a droplet discharged from the paper feeding side nozzle, and a Y-direction position of a dot 82 recorded by a droplet discharged from the paper ejection side nozzle, are displaced from each other in the Y-direction.

A pattern of a dot row designated by a reference numeral 84 in FIG. 7 is an example of an X-direction recording line recorded by nozzles in a non-complementary region in a nozzle array of the (n+1)-th head module 12-(*n*+1). As with the non-complementary region in the n-th head module 12-*n*, recording shift between a paper feeding side nozzle and a paper ejection side nozzle occurs due to a difference between paper sheet feeding speed and discharge timing, a difference in a throw distance, or the like, also in a non-complementary region in the (n+1)-th head module 12-(*n*+1). That is, a Y-direction position of a dot 85 recorded by a droplet discharged from the paper feeding side nozzle, and a Y-direction position of a dot 86 recorded by a droplet discharged from the paper ejection side nozzle, are displaced from each other.

A pattern of a dot row designated by a reference numeral 90 in FIG. 7 is an example of an X-direction recording line recorded by using nozzles in a complementary region between the n-th head module 12-*n* and the (n+1)-th head module 12-(*n*+1).

In the complementary region between the head modules adjacent to each other, each of the paper feeding side nozzle and the paper ejection side nozzle belongs to a different head module, and thus a dot 91 formed of a droplet discharged from the paper ejection side nozzle of the n-th head module 12-*n*, and a dot 92 formed of a droplet discharged from the paper feeding side nozzle of the (n+1)-th head module 12-(*n*+1), alternately align in the X-direction to form a recording line in the complementary region.

Adjusting discharge timing in units of a head module by using the conventional methods shown in Patent Literatures 1 to 3 enables a recording shift amount in a complementary region to be less than a recording shift amount in a non-complementary region. FIG. 7 illustrates a state where an adjustment is performed so that a recording shift amount in a complementary region becomes substantially zero.

However, if discharge timing of a head module is adjusted by applying a conventional method so that a recording shift amount in a complementary region becomes a minimum, an arrangement state of dots is greatly different between a non-complementary region and the complementary region. As a result, uneven concentration or the like tends to easily occur.

In addition, if discharge timing is adjusted between head modules adjacent to each other so that a shift of a deposition position becomes a minimum in a complementary region while a shift of a deposition position in the Y-direction occurs at a paper feeding side nozzle and a paper ejection side nozzle in a non-complementary region of each of the head modules, discharge timing in a region other than the complementary region varies between the head modules adjacent to each other.

Figure 8:
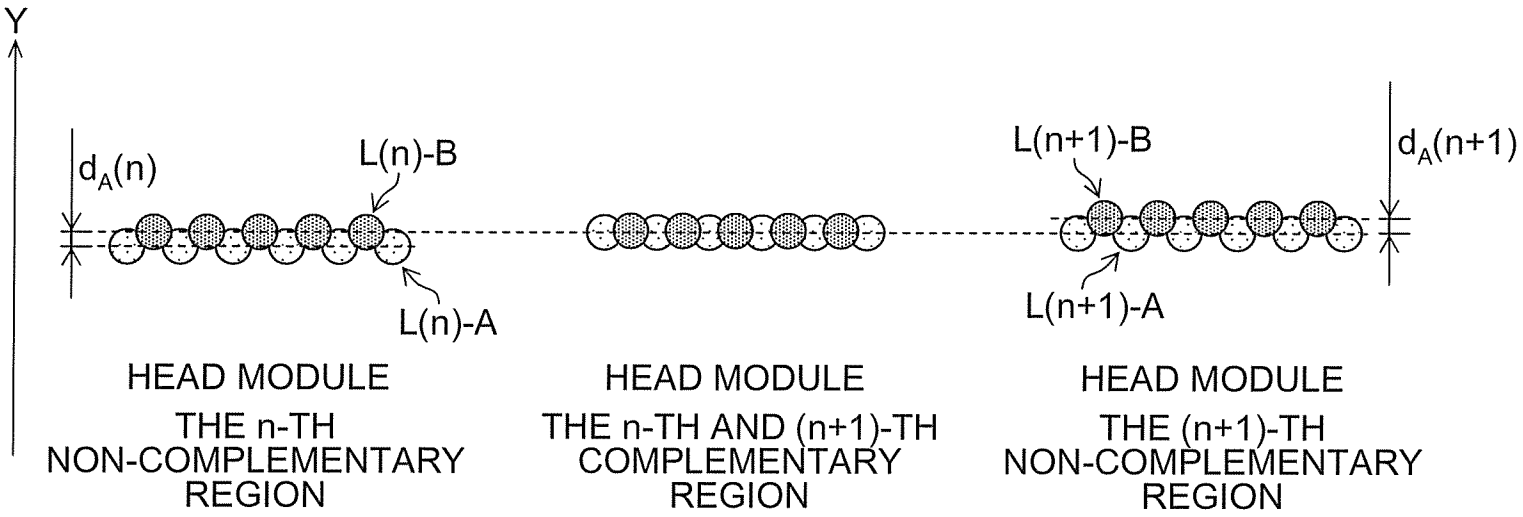
FIG. 8 schematically illustrates a method of adjusting recording shift of a comparative example.

FIG. 8 schematically illustrates a method of adjusting recording shift of a comparative example. There is a recording shift in the Y-direction between a paper feeding side nozzle and a paper ejection side nozzle in a non-complementary region of the n-th head module, and an amount of the recording shift is indicated as $d_A(n)$. There is a recording shift in the Y-direction between the paper feeding side nozzle and the paper ejection side nozzle in a non-complementary region of the (n+1)-th head module, and an amount of the recording shift is indicated as $d_A(n+1)$.

In the comparative example of FIG. 8, discharge timing of the n-th head module and the (n+1)-th head module is relatively adjusted so that a recording shift between the paper feeding side nozzle and the paper ejection side nozzle is eliminated in the complementary region. In this case, as illustrated in FIG. 8, discharge timing between the head modules is adjusted so that a recording position of the paper ejection side nozzle of the n-th head module, and a recording position of the paper feeding side nozzle of the (n+1)-th head module, coincide with each other in the complementary region.

As a result, a recording line L(n)-A formed by supply side nozzles in a non-complementary region in the n-th head module, and a recording line L(n+1)-A formed by supply side nozzles in a non-complementary region in the (n+1)-th head module, are displaced from each other in the Y-direction. Likewise, a recording line L(n)-B formed by paper ejection side nozzles in the non-complementary region in the n-th head module, and a recording line L(n+1)-B formed by paper ejection side nozzles in the non-complementary region in the (n+1)-th head module, are displaced from each other in the Y-direction.

If a plurality of head modules in which discharge timing is adjusted between adjacent head modules as described above is aligned in the X-direction, a difference in discharge timing between each of the head modules is accumulated to cause a problem in that discharge timing is greatly displaced from each other between a head module at one end of a line head in the X-direction and a head module at the other end thereof to vary squareness or the like.

Figure 9:
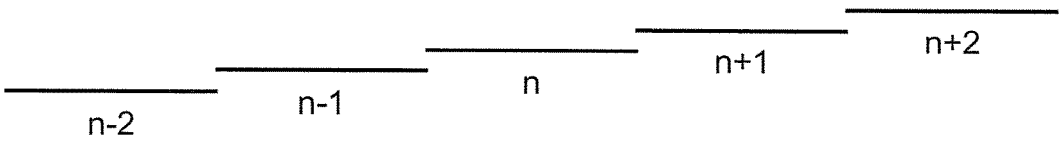
FIG. 9 schematically illustrates a state where a difference in discharge timing between head modules is accumulated by aligning a plurality of head modules in which discharge timing is adjusted by the method illustrated in FIG. 8.

FIG. 9 schematically illustrates a state where a difference in discharge timing between head modules is accumulated by aligning a plurality of head modules in which discharge timing is adjusted by the method illustrated in FIG. 8. FIG. 9 illustrates displacement of a recording position in alignment of five head modules of the (n−2)-th to the (n+2)-th head modules by centering the n-th head module, the displacement being caused by influence of a difference in discharge timing of only paper feeding side nozzles in a non-complementary region in each of the head modules or a difference in discharge timing of only paper ejection side nozzles therein.

As illustrated in FIG. 9, a difference in discharge timing is accumulated according to the order of alignment of the head modules, squareness of an X-direction recording line varies.

As one of correction methods of correcting this kind of variation of squareness, the squareness can be corrected by adjusting an angle of a line head itself in a θz-direction. The θz-direction is a rotation direction with respect to a rotation shaft parallel to the Z-direction. Rotation in the θz-direction is rotation in a plane parallel to a discharge face of the line head.

Figure 10:
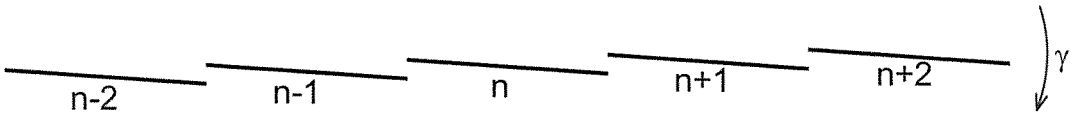
FIG. 10 schematically illustrates a state where recording shifts at opposite ends of a line head are adjusted by turning the whole line head from the state illustrated in FIG. 9.

FIG. 10 schematically illustrates a state where recording shifts at opposite ends of a line head are adjusted by turning the entire line head in the θz-direction by an angle γ from the state illustrated in FIG. 9. As illustrated in FIG. 10, the squareness illustrated in FIG. 9 can be improved by adjusting an angle of the entire line head in the θz-direction.

However, if angle adjustment in the θz-direction, such as illustrated in FIG. 10, is performed, there is a problem in that unevenness and streaks tend to easily occur. Hereinafter, a phenomenon of the problem will be described.

Figure 11:
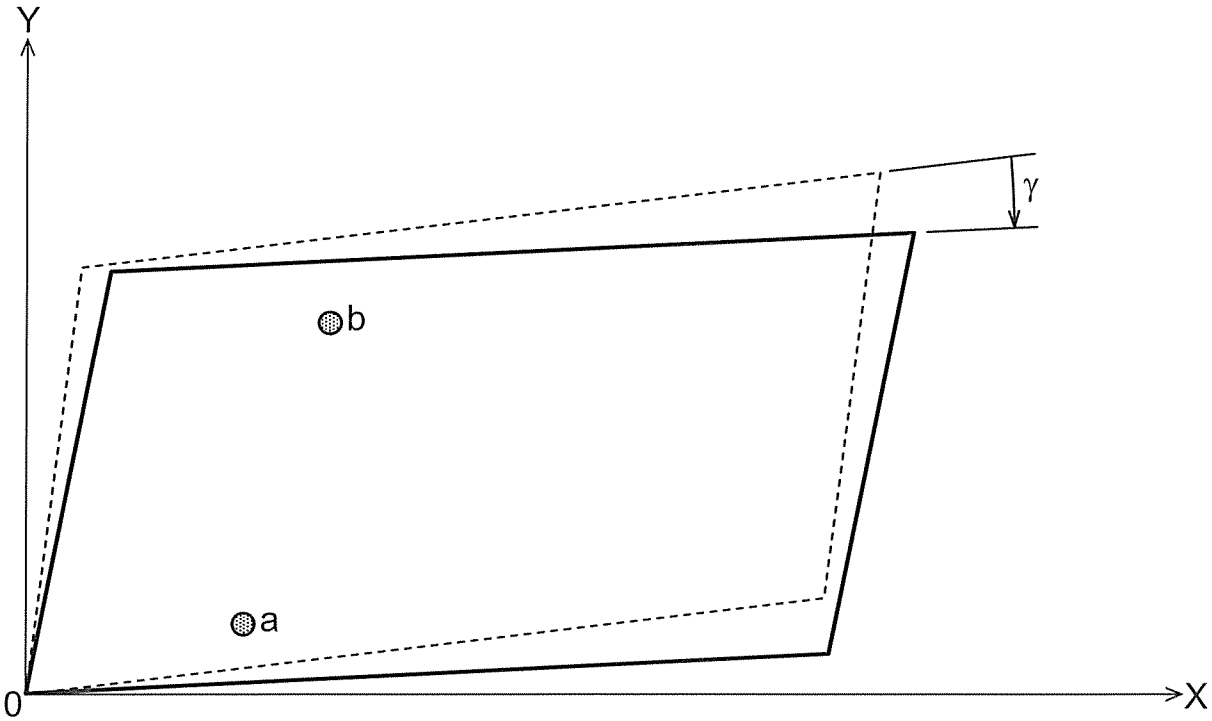
FIG. 11 illustrates change in nozzle position when a head module is turned by an angle $\gamma$.

FIG. 11 illustrates a state of one of head modules when recording shift in the Y-direction between each of the head modules at opposite ends of a line head is corrected by performing angle adjustment of an angle γ in the θz-direction from a state of FIG. 10. FIG. 11 is a schematic diagram illustrating a state where the head module is turned in the θz-direction by an angle γ. In FIG. 11, a bottom left corner of the head module is set as a reference position, for convenience of illustration, and the reference position serves as an original point of nozzle coordinates. In addition, rotation adjustment of an angle γ will be described so as to be performed by setting the reference position as the center of rotation in the θz-direction.

As illustrated in FIG. 6, in a case of nozzle arrangement of a two-dimensional matrix, nozzle positions of two nozzles for recording pixels adjacent to each other in the X-direction are away from each other in the Y-direction. The focused two nozzles each are indicated as either a nozzle a or a nozzle b. A nozzle coordinate of the nozzle a is indicated as (Xa, Ya), and a nozzle coordinate of the nozzle b is indicated as (Xb, Yb). Since the angle γ is a minute amount, approximation of cos γ≈1 and sin γ≈γ holds, where γ is in units of radian unit.

When a head module is turned by an angle γ, a displacement distance ΔYa of the nozzle a in the Y-direction and a displacement distance ΔYb of the nozzle b in the Y-direction can be respectively expressed as follows.

$$\Delta Ya = Xa \times \sin\gamma$$

$$\Delta Yb = Xb \times \sin\gamma$$

Thus, a variation (ΔYa−ΔYb) of a distance in the Y-direction of the nozzle a and the nozzle b caused by rotation of an angle γ is as follows.

$$\Delta Ya - \Delta Yb = (Xa - Xb) \times \gamma$$

However, a value of Xa−Xb is small, and the variation is so small to be negligible.

Meanwhile, when a head module is turned by an angle γ, a displacement distance ΔXa of the nozzle a in the X-direction and a displacement distance ΔXb of the nozzle b in the X-direction can be respectively expressed as follows.

$$\Delta Xa = Ya \times \gamma$$

$$\Delta Xb = Yb \times \gamma$$

Thus, a variation ($\Delta Xa-\Delta Xb$) of a distance in the X-direction of the nozzle a and the nozzle b caused by rotation of an angle $\gamma$ is as follows.

$$\Delta Xa-\Delta Xb=(Ya-Yb)\times\gamma$$

That is, a relative distance in the X-direction of nozzles away from each other in the Y-direction by an amount of (Ya−Yb) varies by an amount of (Ya−Yb)×$\gamma$ by rotation of an angle $\gamma$ in the $\theta z$-direction. For example, when a value of (Ya−Yb) is 10 millimeter and $\gamma$ is 0.5 milli-radian, a relative distance in the X-direction varies by about 5 micrometer, and thus may cause a problem at the time of dense recording at a level of 1200 dpi.

Means for Solve Problem According to the Present Embodiment

In the present embodiment, a recording shift amount in each of non-complementary regions of respective adjacent head modules, and a recording shift amount in a complementary region that is a joined portion between both the head modules, are measured, and relative discharge timing of the adjacent head modules is adjusted on the basis of the measured recording shift amounts so that the recording shift amount in the complementary region becomes an intermediate value between the recording shift amount in each of the non-complementary region in the respective adjacent head modules.

The "adjacent head modules" is synonymous with the "head modules adjacent to each other". The sentence of "relative discharge timing is adjusted" indicates that a relative time difference in discharge timing is adjusted in head modules adjacent to each other. Discharge timing of one of adjacent head modules may be adjusted with reference to discharge timing of the other of the adjacent head modules, or discharge timing of each of the adjacent head modules may be adjusted.

The "intermediate value" is not limited to an average value to be the exactly middle value, and indicates a value between two values. In the "intermediate value", a preferable example in which effect of reducing uneven concentration is a maximum is the "average value", and thus, a specific example described below shows an example in which relative discharge timing of adjacent head modules is adjusted so that a recording shift amount in a complementary region becomes an average value of a recording shift amount in a non-complementary region in each of adjacent head modules.

Figure 12:
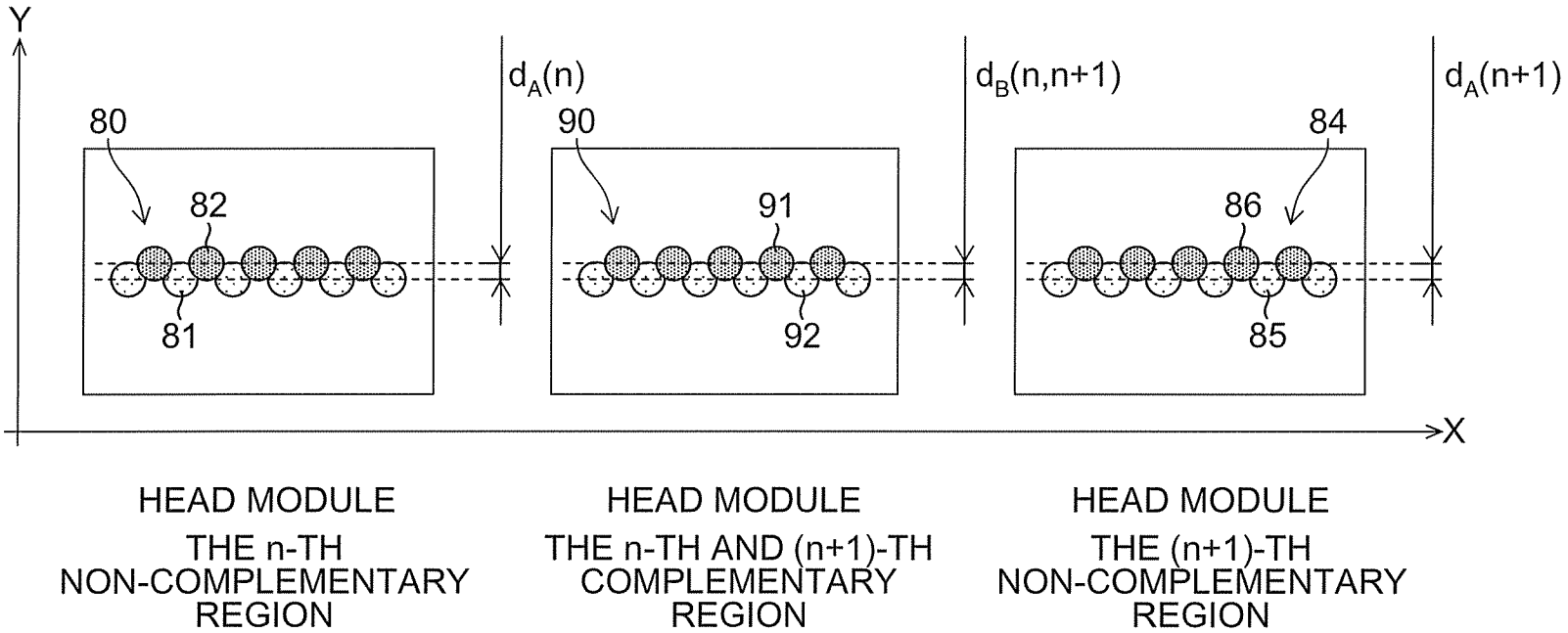
FIG. 12 illustrates a method for adjusting a recording head according to the present embodiment.

FIG. 12 illustrates a method for adjusting a recording head according to the present embodiment. In FIG. 12, an element identical or similar to that illustrated in FIG. 7 is designated by the same reference numeral. When a recording shift amount in a non-complementary region in the n-th head module is indicated as $d_A(n)$ and a recording shift amount in a non-complementary region in the (n+1)-th head module is indicated as $d_A(n+1)$, relative discharge timing of the n-th and the (n+1)-th head modules is adjusted so that a recording shift amount $d_B(n, n+1)$ in a complementary region after adjustment becomes $[d_A(n)+d_A(n+1)]/2$.

For example, when a recording shift amount in a complementary region before adjustment is indicated as $d_{B_be}(n, n+1)$, a recording shift amount in the complementary region after the adjustment is indicated as $d_{B_af}(n, n+1)$, and feeding speed of a paper sheet S being a recording medium is indicated as $V_Y$, a time difference $t_d$ in discharge timing between adjacent head modules causing the recording shift amount $d_{B_af}(n, n+1)$ in the complementary region to be $[d_A(n)+d_A(n+1)]/2$ can be expressed by the following expression.

$$t_d=[d_{B_be}(n,n+1)-(d_A(n)+d_A(n+1))/2]/V_Y$$

Adjustment performed as described above relatively reduces a difference between a recording shift amount in a non-complementary region in adjacent head modules and a recording shift amount in a complementary region therein, and thus a variation between a recording shift amount in the non-complementary region and a recording shift amount in the complementary region becomes moderate (smooth), whereby uneven concentration is less likely to occur.

The method of the present embodiment achieves considerable improvement effect particularly in an angle shift in the $\theta x$-direction of the entire line head, or in a case where a recording shift amount in the Y-direction uniformly occurs in the entire line head, such as a case where a curved face like a paper sheet held by a drum is recorded.

In a case of a recording head using a head module with nozzle arrangement illustrated in FIG. 6, a complementary region in adjacent head modules has 128 pixels, and in 64 pixels in a central portion of the 128 pixels, nozzles of each of adjacent head modules are to be alternately used in the X-direction. In this embodiment, since there is a relationship in which one nozzle is assigned to recording of one pixel position, the 128 pixels in the complementary region are synonymous with 128 nozzles corresponding to the respective pixels.

In the present embodiment, a recording shift amount of each of adjacent head modules is measured by using a region of 64 pixels corresponding to a central portion of a complementary region. For example, an X-direction line is recorded by using nozzles of only one of adjacent head modules according to discharge control of one-on-one-off, and a position in the Y-direction of each of a line recorded by using nozzles of only the n-th head module and a line recorded by using nozzles of only the (n+1)-th head module is measured to enable a recording shift amount in a complementary region to be measured.

The discharge control of one-on-one-off performs recording in which dot-on and dot-off are alternately repeated for a row of pixels along the X-direction. In a case where a recording resolution in the X-direction is 1200 dpi like the present example, a line of a dot row in which dots align can be recorded at 600 dpi by the discharge control of one-on-one-off. Changing a combination of a pixel of dot-on and a pixel of dot-off enables a line to be recorded at 600 dpi by changing nozzles to be used.

Applying discharge control of one-on-one-off to 64 pixels in a central portion of 128 pixels in a complementary region can form a line pattern in which a line of a dot row recorded by using only paper ejection side nozzles of the n-th head module, and a line of a dot row recorded by using only paper feeding side nozzles of the (n+1)-th head module, align in the Y-direction away from each other on a paper sheet.

In a case where two head modules each with the nozzle array illustrated in FIG. 6 are joined side by side, a region of 64 pixels corresponding to a central portion in a complementary region is a range of a total of 64 nozzles where nozzles from the seventeenth row to the thirty second row of each of the sixty second column and the sixty third column of the head module on a left side, and nozzles from the first row to the sixteenth row of each of the second column and the third column of the head module on a right side, overlap with each other so as to alternately align in the X-direction.

In addition, a recording shift amount is measured for not only the complementary region, but also a non-complementary region in each of the adjacent head modules. As with the complementary region, a position in the Y-direction of each of a line recorded by using only paper feeding side nozzles, and a line recorded by using only paper ejection side nozzles, according to one-on-one-off, is measured to enable a recording shift amount to be measured.

Example of Method of Measuring Recording Shift Amount

Figure 13:
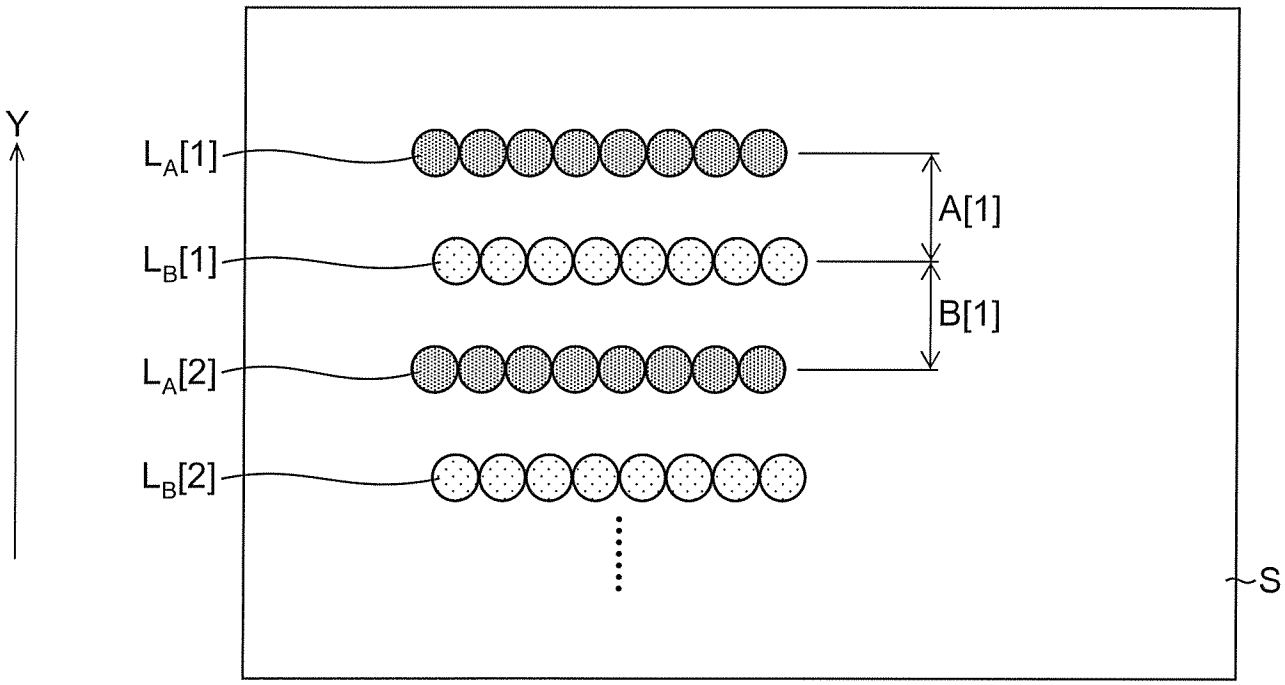
FIG. 13 is a schematic diagram illustrating an example of a pattern for measuring a recording shift amount using discharge control of one-on-one-off.

FIG. 13 is a schematic diagram illustrating an example of a pattern for measuring a recording shift amount using discharge control of one-on-one-off. Hereinafter, a case of measuring a recording shift amount in a non-complementary region in the n-th head module 12-*n* will be described.

A paper sheet S being a recording medium is fed in the Y-direction at a predetermined feeding speed. Nozzles of a recording head 10 discharge droplets to the paper sheet S. In an example of FIG. 13, discharge control of one-on-one-off is applied to a non-complementary region in the n-th head module 12-*n* to record a plurality of X-direction recording lines on the paper sheet S by alternately changing a nozzle group to be used for discharge at predetermined time intervals.

In the nozzle array illustrated in FIG. 6, when a nozzle number of paper feeding side nozzles is an odd number and a nozzle number of paper ejection side nozzles is an even number, an X-direction recording line recorded by a nozzle with an odd number, and an X-direction recording line recorded by a nozzle with an even number, are to be alternately aligned and recorded in the Y-direction on the paper sheet S according to the discharge control of one-on-one-off.

An X-direction recording line $L_A$[1] drawn in the uppermost row in FIG. 13 represents a dot row recorded by paper feeding side nozzles in a non-complementary region. An X-direction recording line $L_B$[1] in the second row from the top in FIG. 13 represents a dot row recorded by the paper feeding side nozzles in the non-complementary region.

An X-direction recording line $L_A$[2] in the third row from the top in FIG. 13 represents a dot row recorded by the paper feeding side nozzles in the non-complementary region. An X-direction recording line $L_B$[2] in the fourth row from the top in FIG. 13 represents a dot row recorded by the paper feeding side nozzles in the non-complementary region.

A pattern for measurement including X-direction recording lines, recorded by alternately changing nozzles to be used as described above, is recorded to measure a distance in the Y-direction between each of the X-direction recording lines.

If a recording shift amount in the non-complementary region is zero, a distance in the Y-direction between each line is equal. Meanwhile, if there is a recording shift amount in the non-complementary region, a distance in the Y-direction between each line is a different value reflecting the shift amount.

A distance A[1] in the Y-direction between the X-direction recording line $L_A$[1] of the first row and the X-direction recording line $L_B$[1] of the second row, as well as, a distance B[1] in the Y-direction between the X-direction recording line $L_B$[1] of the second row and the X-direction recording line $L_A$[2] of the third row is measured, and a difference between the A[1] and the B[1] is acquired to enable a recording shift amount to be measured. Similar measurement may be performed multiple times to increase accuracy of measurement by using statistical processing such as adopting an average value of measurement results.

A recording shift amount in a complementary region also can be measured by using a method similar to the method illustrated in FIG. 13.

A measurement pattern to be used for measurement of a recording shift amount, as well as a method for the measurement is not limited to the example described above. For example, a method of measuring a recording shift amount by using a scanner, an external measurement device, or the like, may be used, or a method of measuring concentration when lines are recorded by varying recording timing to measure a recording shift amount from a relationship between a shift amount and concentration, such as described in Japanese Patent Application Laid-Open No. 2014-136319, may be used.

Depending on a kind of measurement pattern to be used, or a method for measurement, a measurement value of a recording shift amount may vary, and thus it is desirable that a combination of a measurement pattern to be used for measurement of a recording shift amount in a complementary region and a method for the measurement is identical to a combination of a measurement pattern to be used for measurement of a recording shift amount in a non-complementary region and a method for the measurement.

In addition, since nozzles belonging to each of adjacent head modules complement each other to record an X-direction recording line in a complementary region, discharge timing of each of the adjacent head modules needs to appropriately coincide with each other. Accordingly, it is necessary to grasp an amount of shift of a recording position caused by dots of droplets discharged from each of the head modules for the complementary region. Thus, it is desirable that a recording shift amount in the non-complementary region is measured by using a method equivalent to the method of measurement used for measurement of the complementary region.

Example of System Configuration of Ink Jet Recorder

Figure 14:
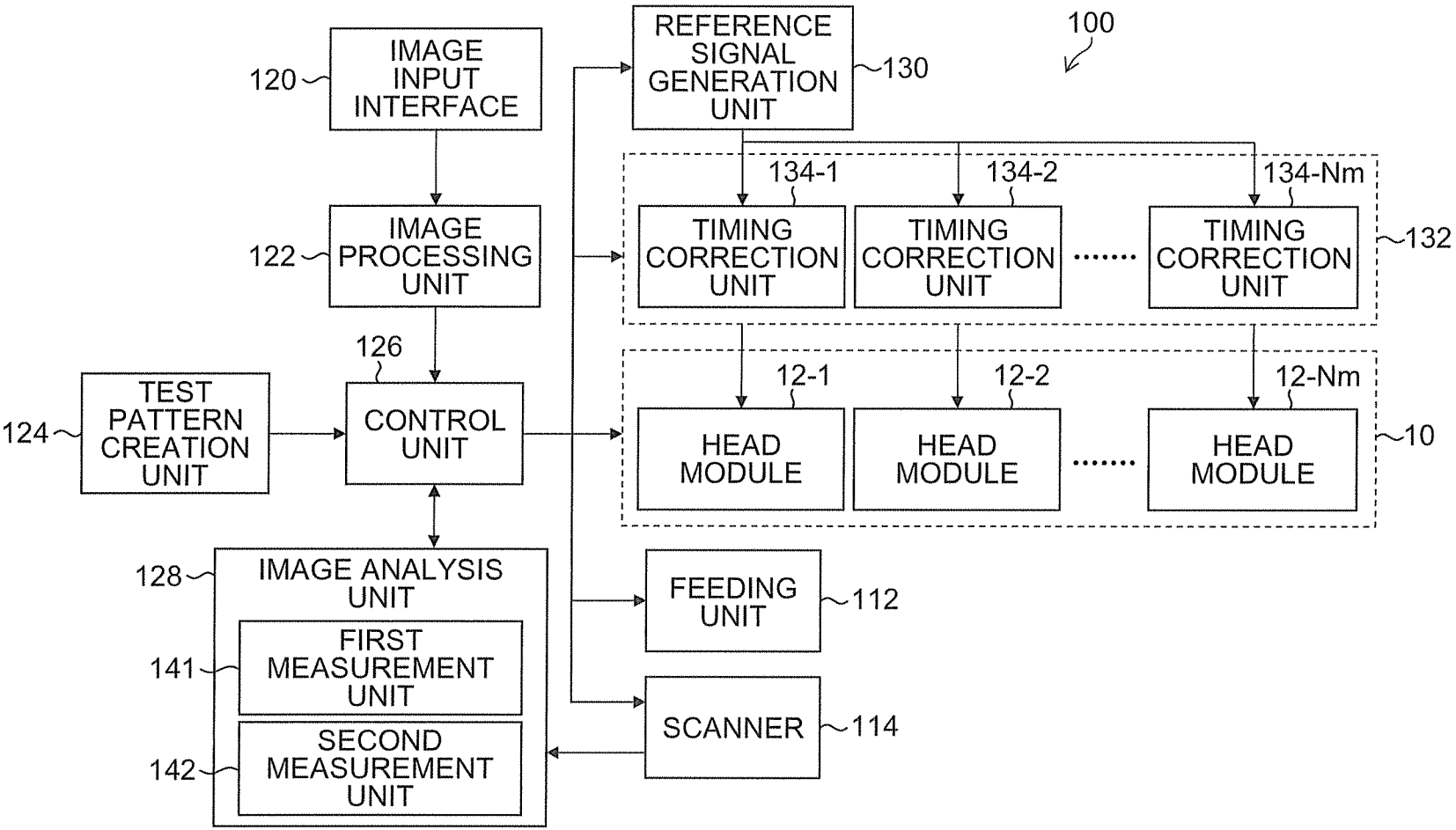
FIG. 14 is a block diagram illustrating an outline of a system configuration of an ink jet recorder according to the present embodiment.

FIG. 14 a block diagram illustrating an outline of a system configuration of an ink jet recorder according to the present embodiment. An ink jet recorder 100 includes a recording head 10, a feeding unit 112, and a scanner 114. In addition, the ink jet recorder 100 includes an image input interface 120, an image processing unit 122, a test pattern creation unit 124, a control unit 126, an image analysis unit 128, a reference signal generation unit 130, and a timing adjustment unit 132. Each unit illustrated in FIG. 14 can be configured by appropriately combining hardware and software.

The recording head 10 is a line head formed by joining a plurality of head modules 12-*i* in the X-direction. In the reference numeral "12-*i*", "i" represents a head module number, and is an integer from 1 to Nm.

The feeding unit 112 includes a mechanism of feeding a paper sheet as a recording medium in the Y-direction, and a power source for feed drive.

The image input interface 120 acquires image data through a wired or wireless communication interface. The image processing unit 122 applies a required image processing to the received image data. The image processing unit 122 performs image processing such as color conversion processing, gradation conversion processing, and halftone processing.

The test pattern creation unit 124 creates data on various test patterns. The test pattern creation unit 124 can create data on various test patterns such as a pattern for measurement to be used for measuring a recording shift amount in a non-complementary region in each of adjacent head modules in the recording head 10, a pattern for measurement to be used for measuring a recording shift amount in a complementary region therein, and a pattern for inspection to be used for inspecting a discharge state of each nozzle in the recording head.

The control unit 126 performs integrated control for each unit in the ink jet recorder 100. The control unit 126 can control the recording head 10, the reference signal generation unit 130, the timing adjustment unit 132, the feeding unit 112, the scanner 114, and the image analysis unit 128, on the basis of at least one of image data processed by the image processing unit 122 and data on test patterns to be acquired from the test pattern creation unit 124. The control unit 126 serves as an arithmetic processing unit that performs various calculations.

The reference signal generation unit 130 includes an oscillation circuit, a divider circuit, and a waveform shaping circuit, which are not illustrated, and generates a reference signal of a drive waveform signal to be supplied to a discharge energy generation element corresponding to one of nozzles provided in the corresponding head module 12-*i*.

The timing adjustment unit 132 includes timing correction units 134-*i* (i=1, 2, . . . Nm) for the corresponding head modules 12-*i* to correct discharge timing. The timing adjustment unit 132 corrects timing for each head module 12-*i* with respect to the reference signal received from the reference signal generation unit 130, and supplies a corrected timing signal to each head module 12-*i*.

The timing correction unit 134-*i* includes a delay circuit, which can set a delay amount, to delay a received reference signal by a set delay amount, and supplies the reference signal to each head module 12-*i*. Accordingly, discharge timing of a nozzle can be set to appropriate timing for each head module 12-*i*, and thus discharge timing can be relatively varied between head modules.

In addition, the control unit 126 supplies a nozzle selection signal to each head module 12-*i* to select a nozzle for discharging a droplet. Accordingly, a droplet can be discharged from a desired nozzle of each head module 12-*i* at desired timing to record a dot on a recording face of a paper sheet S.

The control unit 126 can cause the recording head 10 to record an image on the recording face of the paper sheet S by controlling the recording head 10 and the feeding unit 112.

The scanner 114 is disposed downstream of the recording head 10 in a paper sheet feeding direction in a paper sheet feeding path to read out an image recorded on the paper sheet S by the recording head 10. In the present embodiment, a resolution less than a recording resolution of the recording head 10 is used as a reading resolution of the scanner 114. For example, a reading resolution of the scanner 114 in the X-direction is 480 dpi, and a reading resolution thereof in the Y-direction is 100 dpi.

Readout data read out by the scanner 114 is inputted into the image analysis unit 128. The image analysis unit 128 measures a recording shift amount from the received readout data. The image analysis unit 128 includes a first measurement unit 141 and a second measurement unit 142. The first measurement unit 141 measures a complementary region recording shift amount, which is a recording shift amount in the Y-direction in a complementary region in a joined portion between the n-th head module and the (n+1)-th head module that are head modules adjacent to each other, on the basis of the readout data.

The second measurement unit 142 measures a first non-complementary region recording shift amount, which is a recording shift amount in the Y-direction in a non-complementary region in a nozzle array of the n-th head module, and a second non-complementary region recording shift amount, which is a recording shift amount in the Y-direction in a non-complementary region in a nozzle array of the (n+1)-th head module, on the basis of the readout data.

Information on the complementary region recording shift amount, the first non-complementary region shift amount, and the second non-complementary region shift amount, acquired by the image analysis unit 128, is transmitted to the control unit 126. The control unit 126 calculates a timing adjustment value to adjust discharge timing of adjacent head modules on the basis of the first non-complementary region shift amount and the second non-complementary region shift amount, acquired from the image analysis unit 128. The control unit 126 includes a calculation unit (not illustrated) that performs calculation to calculate a timing adjustment value. The calculation unit for calculating a timing adjustment value may be included in the image analysis unit 128. The control unit 126 sets a delay amount of the corresponding timing correction unit 134-*i* in the timing adjustment unit 132 in accordance with the calculated timing adjustment value.

Method of Adjusting Discharge Timing of Recording Head

Figure 15:
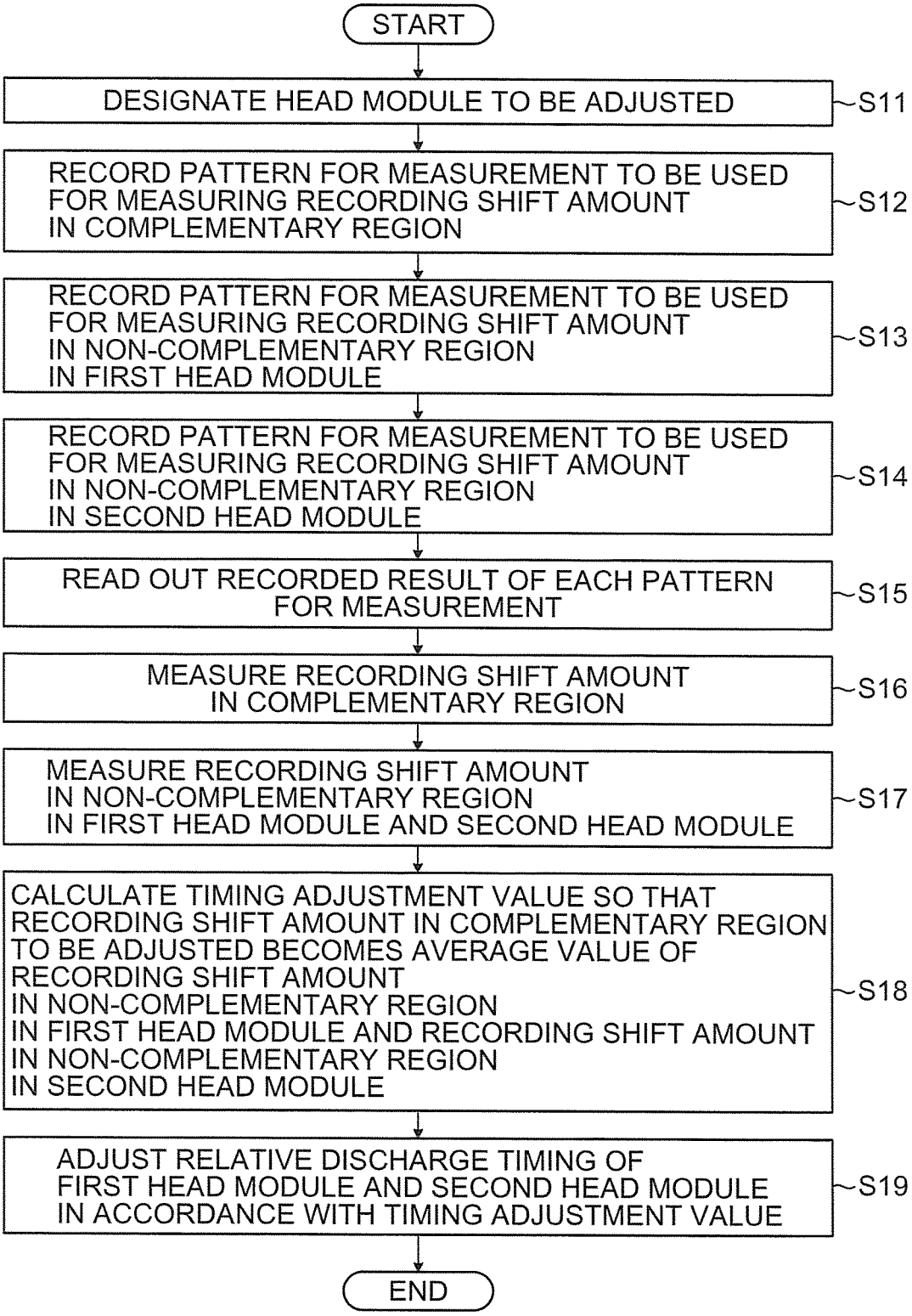
FIG. 15 is a flow chart illustrating a procedure of a method for adjusting a recording head according to the present embodiment.

FIG. 15 is a flow chart illustrating a procedure of a method for adjusting a recording head according to the present embodiment. Each step of the flow chart illustrated in FIG. 15 is performed by a processing function of the control unit 126 in the ink jet recorder 100, or operation of the ink jet recorder 100 according to control of the control unit 126, for example. The flow chart illustrated in FIG. 15 is performed as a method of adjustment when some of the head modules 12 in the recording head 10 being a line head is exchanged, for example.

In step S11, the control unit 126 first designates a head module to be adjusted. Here, the n-th head module and the (n+1)-th head module adjacent to each other are designated as head modules to be adjusted. For example, when a head module in a recording head is exchanged, an operator performs input operation to identify a head module to be adjusted, through an appropriate user interface. According to the input operation, the head module to be adjusted is determined. Alternatively, a head module to be adjusted may be automatically designated by configuring the control unit 126 to automatically recognize an exchanged head module. Here, the n-th head module and the (n+1)-th head module adjacent to each other are designated as head modules to be adjusted. Hereinafter, the n-th head module is referred to as a "first head module", and the (n+1)-th head module is referred to as a "second head module".

Next, in step S12, the ink jet recorder 100 records a pattern for measurement to be used for measuring a recording shift amount in a complementary region on a paper sheet S by using the first head module and the second head module to be adjusted, according to control of the control unit 126. The pattern for measurement recorded in step S12 corresponds to a form of the "first test pattern". Step S12 corresponds to a form of a "step of recording the first test pattern". In addition, in step S13, the ink jet recorder 100 records a pattern for measurement to be used for measuring a recording shift amount in a non-complementary region in the first head module on a paper sheet S, according to control of the control unit 126. The pattern for measurement recorded in step S13 corresponds to a form of the "second test pattern". Step S13 corresponds to a form of a "step of recording the second test pattern".

Further, in step S14, the ink jet recorder 100 records a pattern for measurement to be used for measuring a recording shift amount in a non-complementary region in the second head module on a paper sheet S, according to control of the control unit 126. The pattern for measurement recorded in step S14 corresponds to a form of the "third test pattern". Step S14 corresponds to a form of a "step of recording the third test pattern".

Each of the first test pattern that is a pattern for measurement to be used for measuring a recording shift amount in a complementary region, the second test pattern that is a pattern for measurement to be used for measuring a recording shift amount in a non-complementary region in the first head module, and the third test pattern that is a pattern for measurement to be used for measuring a recording shift amount in a non-complementary region in the second head module, may be recorded on the same paper sheet S, or may be separately recorded in different paper sheets S. Implement order of the step of recording the first test pattern of step S12, the step of recording the second test pattern of step S13, and the step of recording the third test pattern of step S14, is not limited, and a plurality of steps of recording a test pattern may be simultaneously implemented.

In each of the step of recording the first test pattern of step S12, the step of recording the second test pattern of step S13, and the step of recording the third test pattern of step S14, a step of feeding a recording medium corresponds to a form of the "feeding step".

In step S15, a recorded result of each of patterns for measurement of the first test pattern, the second test pattern, and the third test pattern, is read out by using the scanner 114. The scanner 114 reads out the recorded result of each of the patterns for measurement to create readout data.

The recorded result of each of patterns for measurement of the first test pattern, the second test pattern, and the third test pattern, may be separately read out, or the patterns for measurement may be collectively read out at a time. In step S15, readout data on the recorded result of each of the first test pattern, the second test pattern, and the third test pattern, is acquired. Step S15 corresponds to a form of the "reading step".

In step S16, the first measurement unit 141 of the image analysis unit 128 measures a recording shift amount in a complementary region on the basis of readout data on the first test pattern. The recording shift amount in the complementary region measured in step S16 corresponds to a form of the "complementary region recording shift amount". Step S16 corresponds to a form of the "first measurement step".

In step S17, the second measurement unit 142 of the image analysis unit 128 measures a recording shift amount in a non-complementary region in each of the first head module and the second head module on the basis of readout data on the second test pattern and the third test pattern. The recording shift amount in the non-complementary region in the first head module is measured from readout data on the second test pattern. The recording shift amount in the non-complementary region in the second head module is measured from readout data on the third test pattern.

The recording shift amount in the non-complementary region in the first head module measured in step S17 corresponds to a form of the "first non-complementary region recording shift amount". The recording shift amount in the non-complementary region in the second head module measured in step S17 corresponds to a form of the "second non-complementary region recording shift amount". Step S17 corresponds to a form of the "second measurement step".

In step S18, the control unit 126 calculates a timing adjustment value so that a recording shift amount in a complementary region to be adjusted becomes an average value of a recording shift amount in the non-complementary region in the first head module and a recording shift amount in the non-complementary region in the second head module. The timing adjustment value calculated in step S18 corresponds to a form of the "adjustment value of discharge timing". Step S18 corresponds to a form of the "calculation step". The timing adjustment value may indicate an adjustment amount of discharge timing of each of the first head module and the second head module, or may indicate an adjustment amount of discharge timing of any one of the first head module and the second head module.

In step S19, the control unit 126 adjusts relative discharge timing of the first head module and the second head module in accordance with the timing adjustment value calculated in step S18. The control unit 126 sets a delay amount of each of the corresponding timing correction units 134-*n* and 134-(*n*+1) in the timing adjustment unit 132 in accordance with the timing adjustment value. A combination of step S18 and step S19 corresponds to a form of the "timing adjustment step".

Preferable Conditions for Measuring Recording Shift Amount

Preferable conditions for measuring a recording shift amount in a non-complementary region in each of head modules adjacent to each other will be described.

Preferable Condition 1

It is preferable that a recording shift amount in a non-complementary region in each of head modules adjacent to each other is measured at a position close to a complementary region. This enables uneven concentration caused by a difference in recording shift amount between the non-complementary region and the complementary region to be further reduced.

Figure 16:
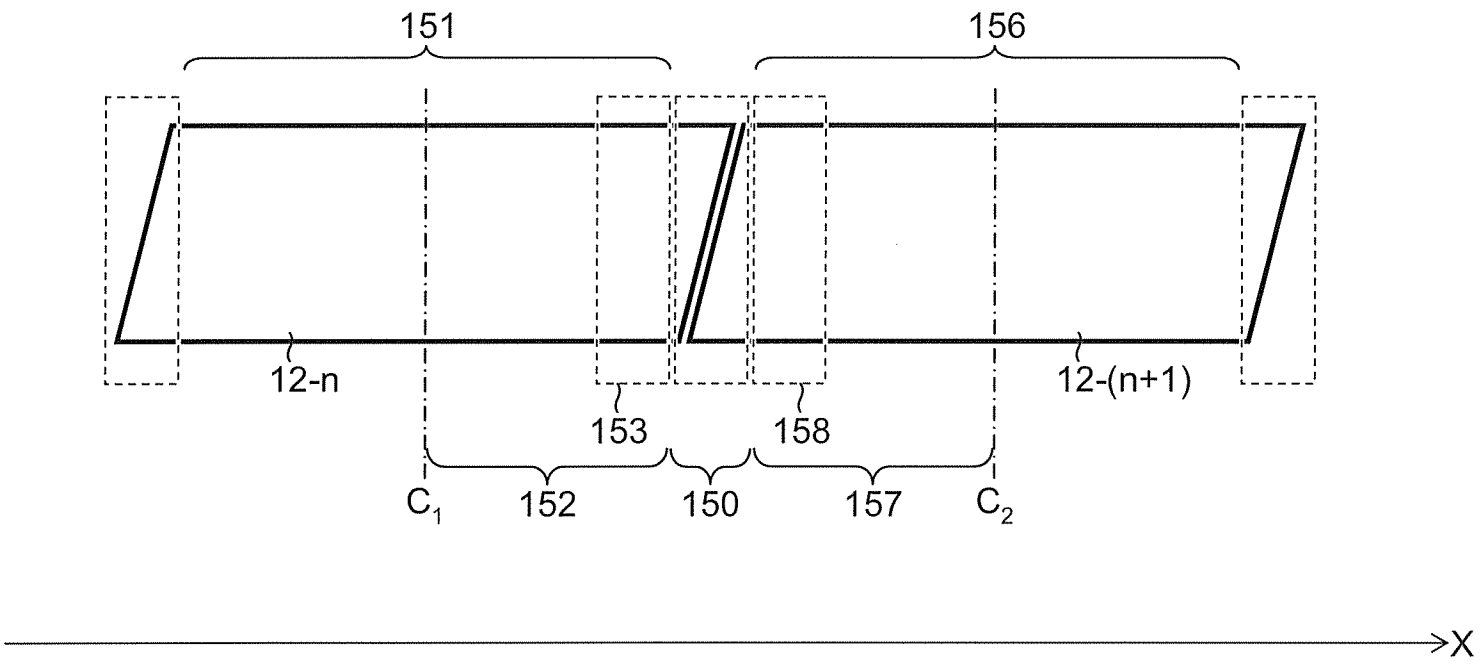
FIG. 16 is a schematic plane view of head modules adjacent to each other.

A guideline of the "position close to the complementary region" will be described with reference to FIG. 16. FIG. 16 is a schematic plane view of the n-th head module 12-*n* and the (n+1)-th head module 12-(*n*+1). In FIG. 16, illustration of nozzles is eliminated.

There is a complementary region 150 in a joined portion between the n-th head module 12-*n* as the first head module, and the (n+1)-th head module 12-(*n*+1) as the second head module. When the first non-complementary region recording shift amount that is a recording shift amount in the non-complementary region in the first head module is measured, it is preferable to measure it by using a region 152 closer to the (n+1)-th head module 12-(*n*+1) than a center position $C_1$ of the head module 12-*n* in the X-direction in a non-complementary region 151 in the n-th head module 12-*n*. It is further preferable to measure the first non-complementary region recording shift amount at a position in proximity to the complementary region 150, as designated by a reference numeral 153.

Likewise, when the second non-complementary region recording shift amount that is a recording shift amount in the non-complementary region in the second head module is measured, it is preferable to measure it by using a region 157 closer to the n-th head module 12-*n* than a center position $C_2$ of the head module 12-(*n*+1) in the X-direction in a non-complementary region 156 in the (n+1)-th head module 12-(*n*+1). It is further preferable to measure the second non-complementary region recording shift amount at a position in proximity to the complementary region 150, as designated by a reference numeral 158.

Preferable Condition 2

In addition, it is preferable that measurement of a recording shift amount is performed to measure an amount of displacement of a recording position of each of nozzles away from each other in the Y-direction to the maximum in nozzles in proximity to each other in the X-direction. A guideline of proximity in "nozzles in proximity to each other in the X-direction" can be represented as nozzles in proximity to each other in the X-direction within a nozzle range in the X-direction with a width equivalent to a width of a complementary region that is a width of the complementary region 150 in the X-direction, for example. In a case of the nozzle array illustrated in FIG. 6, a range of nozzles in the X-direction to be used for measurement of a recording shift amount in a complementary region is 64 pixels, and thus when a recording shift amount in a non-complementary region is measured, it is preferable to measure an amount of displacement of a recording position of each of nozzles away from each other in the Y-direction to the maximum within a range of nozzles in the X-direction equivalent to 64 pixels in the non-complementary region.

That is, when the first non-complementary region recording shift amount is measured, it is preferable to measure an amount of displacement of a recording position of each of nozzles away from each other in the Y-direction to the maximum, in nozzles in proximity to each other in the X-direction within a range of nozzles in the X-direction with a width equivalent to a width of a complementary region that is a width of the complementary region 150 in the X-direction, in nozzles belonging to a non-complementary region 151 in the first head module. In addition, when the second non-complementary region recording shift amount is measured, it is preferable to measure an amount of displacement of a recording position of each of nozzles away from each other in the Y-direction to the maximum, in nozzles in proximity to each other in the X-direction within a range of nozzles in the X-direction with a width equivalent to a width of a complementary region, in nozzles belonging to a non-complementary region 156 in the second head module.

In a case of the nozzle array illustrated in FIG. 6, nozzles belonging to a nozzle array in a row direction in the first row on the most paper feeding side, and nozzles belonging to a nozzle array in a row direction in the thirty second row on the most paper ejection side, correspond to the "nozzles away from each other to the maximum".

It is further preferable to satisfy the conditions of both of the "preferable condition 1" and the "preferable condition 2" described above.

Configuration Example of Ink Jet Recorder

Figure 17:
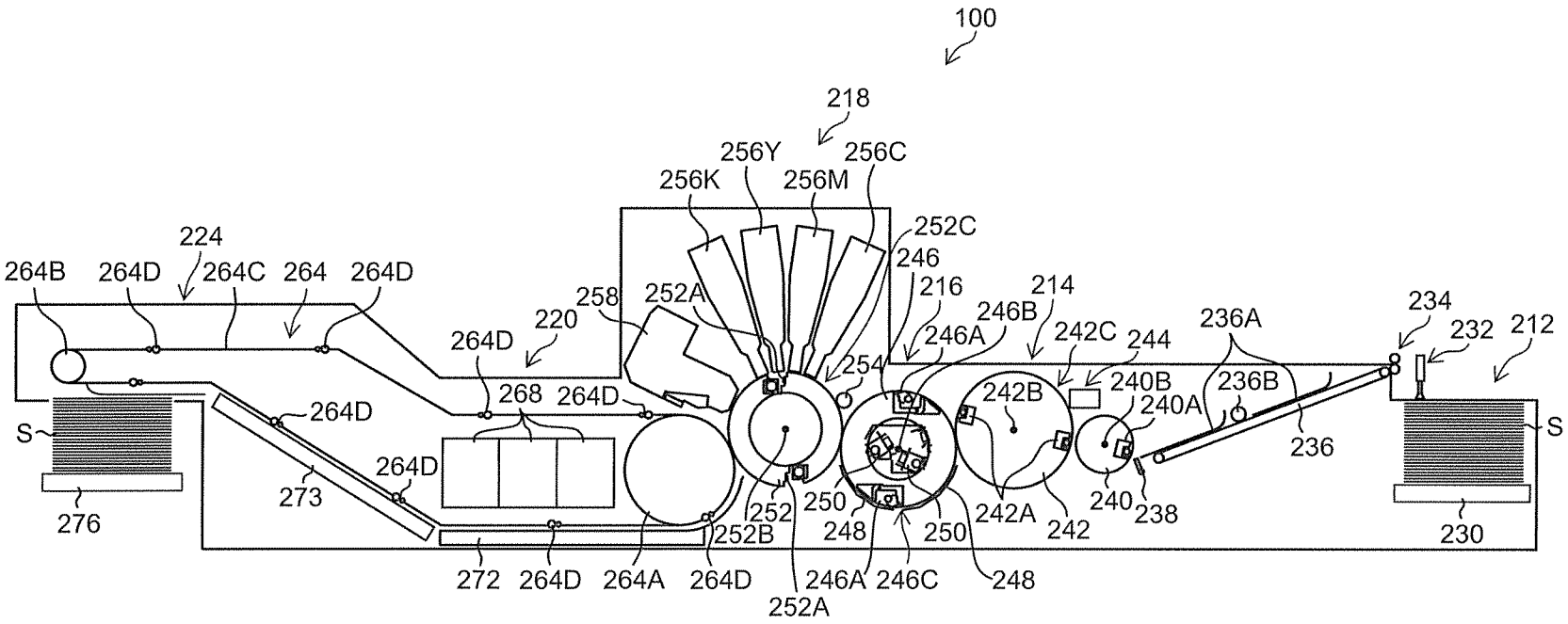
FIG. 17 is a general structural view of the ink jet recorder according to the present embodiment.

FIG. 17 is a general structural view of the ink jet recorder according to the present embodiment. The ink jet recorder 100 is an image forming apparatus of a single pass method, provided with a line head, and draws an image on a cut-sheet paper S by using ink. The paper sheet S is a form of a "recording medium" to be used for image formation.

The ink jet recorder 100 includes a paper feeding unit 212, a treatment liquid applying unit 214, a treatment liquid drying processing unit 216, a drawing unit 218, an ink drying processing unit 220, and a paper ejection unit 224.

The paper feeding unit 212 includes a paper feeding base 230, a paper feeding device 232, a pair of paper feeding rollers 234, a feeder board 236, a front stopper 238, and a paper feeding barrel 240. The paper sheets S loaded on the paper feeding base 230 is pulled up one by one from top to bottom by suction fitting of the paper feeding device 232 to be fed to the pair of paper feeding rollers 234. In the present example, while cut-sheet paper is used as the paper sheet S, there is available a configuration of feeding a paper sheet by cutting a continuous paper sheet into a sheet of a required size.

The paper sheet S fed to the pair of paper feeding rollers 234 is fed forward in a paper sheet feeding direction by the pair of paper feeding rollers 234 to be loaded on the feeder board 36. The paper sheet S loaded on the feeder board 236 is pressed on a feeding face of the feeder board 236 by a retainer 236A and a guide roller 236B during a feeding process by using the feeder board 236, and thus its unevenness is corrected.

A leading end of the paper sheet S fed by the feeder board 236 is brought into contact with the front stopper 238, and then an inclination of the paper sheet S is corrected. After that, the paper sheet S is delivered to the paper feeding barrel 240.

The paper feeding barrel 240 includes a gripper 240A. The gripper 240A is holding means for holing a leading end of the paper sheet S. The gripper 240A includes a plurality of claws, a claw base, and a gripper shaft, which are not illustrated. The plurality of claws of the gripper 240A is arranged along a direction parallel to a rotation shaft 240B of the paper feeding barrel 240. Base ends of the plurality of claws are supported by a gripper shaft in a swingable manner. Arrangement intervals of the plurality of claws, and a length of a region where the plurality of claws is arranged, are determined in accordance with a size of the paper sheet S. The claw base is a member whose longitudinal direction is parallel to the rotation shaft 240B of the paper feeding barrel 240. A length of the claw base is equal to or more than the length of the region where the plurality of claws is arranged in a longitudinal direction of the paper feeding barrel 240. The claw base is arranged at a position facing leading ends of the plurality of claws.

The paper sheet S delivered from the feeder board 236 to the paper feeding barrel 240 is fed to the treatment liquid applying unit 214 while its leading end is held by the gripper 240A of the paper feeding barrel 240.

The treatment liquid applying unit 214 is means for applying a treatment liquid on a recording face of the paper sheet S. The treatment liquid applying unit 214 includes a treatment liquid barrel 242, and a treatment liquid applying device 244. The treatment liquid contains a component that agglomerates color material in ink, or increases viscosity of the color material. A specific method of agglomerating color material, or increasing viscosity of the color material, includes a method of using treatment liquid that reacts with ink to precipitate or insolubilize color material in the ink, and a method of using treatment liquid that creates gel being a semi-solid substance containing color material in ink. Means for causing reaction between ink and treatment liquid includes a method of causing anionic color material in ink and a cationic compound in treatment liquid to react with each other, a method of mixing ink and treatment liquid, having potential of hydrogen (pH) different from each other, to change the pH of the ink to cause distribution rupture of a pigment in ink, thereby agglomerating the pigment, and a method of causing distribution rupture of a pigment in ink by using reaction to multivalent metal salt in treatment liquid to agglomerate the pigment, for example.

The treatment liquid barrel 242 has a diameter double that of the paper feeding barrel 240. The treatment liquid barrel 242 is provided with grippers 242A at two respective places in the circumferential direction. Placement positions of the two respective grippers 242A are 180° apart on an outer peripheral surface 242C of the treatment liquid barrel 242. The gripper 242A may have structure similar to that of the gripper 240A of the paper feeding barrel 240.

The treatment liquid barrel 242 has structure in which a paper sheet S is fixed to the outer peripheral surface 242C on which the paper sheet S is supported. An example of the structure in which a paper sheet S is fixed to the outer peripheral surface 242C of the treatment liquid barrel 242 includes structure in which the outer peripheral surface 242C of the treatment liquid barrel 242 is provided with a plurality of absorption holes so that negative pressure is applied to the plurality of absorption holes. As structure of the treatment liquid barrel 242 other than that described above, structure similar to that of the paper feeding barrel 240 can be used. Reference numeral 242B designates a rotation shaft of the treatment liquid barrel 242.

The treatment liquid applying device 244 may use a roller coating method. The treatment liquid applying device 244 of the roller coating method may use structure in which a treatment liquid reservoir, a metering roller, and a coating roller are provided. An illustration of each of the treatment liquid reservoir, the metering roller, and the coating roller is eliminated.

The treatment liquid reservoir stores treatment liquid that is supplied from a treatment liquid tank through a treatment liquid supply system. An illustration of each of the treatment liquid supply system and the treatment liquid tank is eliminated. The metering roller measures the treatment liquid stored in the treatment liquid reservoir. The metering roller transfers the measured treatment liquid to the coating roller. The coating roller applies the treatment liquid to a paper sheet S.

The structure of the treatment liquid applying device 244 described above is only an example, and the treatment liquid applying device 244 may use another method. In addition, the treatment liquid applying device 244 may have another structure. An example of another method of the treatment liquid applying device 244 includes coating using a blade, discharge by an ink-jet method, and spray by a spray method.

Turning the treatment liquid barrel 242 while a leading end of a paper sheet S is held by the gripper 242A allows the paper sheet S to be fed along an outer peripheral surface of the treatment liquid barrel 242. The treatment liquid applying device 244 applies treatment liquid to the paper sheet S fed along the outer peripheral surface of the treatment liquid barrel 242. The paper sheet S to which the treatment liquid is applied is fed to the treatment liquid drying processing unit 216.

The treatment liquid drying processing unit 216 includes a treatment liquid drying processing barrel 246, a paper sheet feeding guide 248, and a treatment liquid drying processing unit 250. The treatment liquid drying processing unit 216 applies drying processing to the paper sheet S to which the treatment liquid is applied. The treatment liquid drying processing barrel 246 has a diameter equivalent to that of the treatment liquid barrel 242, and is provided with grippers 246A at two respective places in a circumferential direction, as with the treatment liquid barrel 242. The gripper 246A may have structure similar to that of the gripper 240A of the paper feeding barrel 240. Reference numeral 246B designates a rotation shaft of the treatment liquid drying processing barrel 246.

The paper sheet feeding guide 248 is disposed at a position facing the outer peripheral surface 246C of the treatment liquid drying processing barrel 246. The paper sheet feeding guide 248 is disposed on a lower side of the treatment liquid drying processing barrel 246. In the present specification, the "lower side" is a side of a direction of gravitational force, and an "upper side" is a side opposite to the direction of gravitational force.

The treatment liquid drying processing unit 250 is disposed inside the treatment liquid drying processing barrel 246. The treatment liquid drying processing unit 250 includes a blower that blows toward the outside of the treatment liquid drying processing barrel 246, and a heater that heats air. For convenience of illustration, a reference numeral of each of the blower and the heater is eliminated.

A leading end of the paper sheet S delivered from the treatment liquid applying unit 214 to the treatment liquid drying processing unit 216 is held by the gripper 246A of the treatment liquid drying processing barrel 246.

The paper sheet S is held by the gripper 246A while its face coated with the treatment liquid faces the inside of the treatment liquid drying processing barrel 246, and its face opposite to the face coated with the treatment liquid is supported by the paper sheet feeding guide 248. Turning the treatment liquid drying processing barrel 246 allows the paper sheet S to be fed along the outer peripheral surface 246C of the treatment liquid drying processing barrel 246.

The treatment liquid drying processing unit 250 blows heated air to the paper sheet S fed by the treatment liquid drying processing barrel 246 to perform drying processing.

When the drying processing is applied to the paper sheet S, a solvent component in the treatment liquid applied to the paper sheet S is removed to form a treatment liquid layer in the face coated with the treatment liquid of the paper sheet S. The paper sheet S to which the drying processing is applied by the treatment liquid drying processing unit 216 is delivered to the drawing unit 218.

The drawing unit 218 includes a drawing barrel 252, a paper sheet pressing roller 254, recording heads 256C, 256M, 256Y, and 256K, and an in-line sensor 258. A gripper 252A of the drawing barrel 252 is disposed in a recessed portion provided in the outer peripheral surface 252C of the drawing barrel 252. Structure similar to that of the gripper 240A of the paper feeding barrel 240 may be used for structure of the gripper 252A other than placement thereof.

The grippers 252A are disposed at two respective places in the drawing barrel 252, as with the treatment liquid barrel 242. In addition, absorption holes for absorbing a paper sheet S are arranged in a medium support region, where the paper sheet S is to be supported, in the outer peripheral surface 252C of the drawing barrel 252. An illustration of each of the absorption hole, and the medium support region is eliminated. As structure of the drawing barrel 252 other than that described above, structure similar to that of the treatment liquid barrel 242 can be used. Reference numeral 252B designates a rotation shaft of the drawing barrel 252.

The paper sheet pressing roller 254 presses a paper sheet S toward the drawing barrel 252 to bring the paper sheet S into close contact with an outer peripheral surface of the drawing barrel 252. The paper sheet pressing roller 254 is disposed downstream of a delivery position of a paper sheet S, as well as upstream of the recording head 256C, in a feeding direction of a paper sheet S in the drawing barrel 252. In the following description, the feeding direction of a paper sheet S may be sometimes referred to as a paper sheet feeding direction. The outer peripheral surface of the drawing barrel 252 corresponds to a form of the "curved face". A step of feeding a paper sheet S by using the drawing barrel 252 corresponds to a form of the "feeding step".

Each of the recording heads 256C, 256M, 256Y, and 256K is an ink jet head in which liquid is discharged by an ink-jet method. The letter added to a reference numeral of each of the recording heads represents color of ink. The letter C represents cyan. The letter M represents magenta. The letter Y represents yellow. The letter K represents black.

Each of the recording heads 256C, 256M, 256Y, and 256K is equivalent to the recording head 10 illustrated in FIG. 1. To each of the recording heads 256C, 256M, 256Y, and 256K, ink is supplied from an ink tank (not illustrated) that is an ink supply source of the corresponding color through a piping path (not illustrated).

Each of the recording heads 256C, 256M, 256Y, and 256K is an ink jet head of a full line type with a width in which drawing is allowed, the width corresponding to a maximum width of an image formation region in a paper sheet S. Each of the recording heads 256C, 256M, 256Y, and 256K has structure equivalent to that of the recording head 10 illustrated in FIG. 1. In a discharge face of each of the recording heads 256C, 256M, 256Y, and 256K, nozzle arrays in each of which a plurality of nozzle apertures being liquid discharge ports is arranged are formed throughout the width in which drawing is allowed. In the present disclosure, a recording head may be sometimes referred to as simply a "head".

Each of the recording heads 256C, 256M, 256Y, an 256K is disposed above the drawing barrel 252 in a posture in which a nozzle face of each of the heads is inclined with respect to a horizontal surface so that a nozzle face of each of the heads has a substantially constant interval with respect to a peripheral surface of the drawing barrel 252. That is, the recording heads 256C, 256M, 256Y, and 256K are radially disposed on a concentric circle centering the rotation shaft 252B of the drawing barrel 252 at predetermined intervals in a circumferential direction. In the present example, the four heads are symmetrically disposed across a vertical line (center line) passing through the rotation center of the drawing barrel 252.

As described above, the nozzle face of each of the recording heads 256C, 256M, 256Y, and 256K is disposed to face the outer peripheral surface of the drawing barrel 252, as well as is disposed at a position at a predetermined height from the outer peripheral surface of the drawing barrel 252 in a radial direction (direction perpendicular to the outer peripheral surface). That is, the same amount of gap is formed between the outer peripheral surface of the drawing barrel 252 and the nozzle face of each of the heads.

The recording heads 256C, 256M, 256Y, and 256K are disposed along a circumferential direction of the drawing barrel 252 in the order of the recording head 256C, the recording head 256M, the recording head 256Y, and the recording head 256K from an upstream side in the paper sheet feeding direction.

While the present example shows a configuration in which four color inks of standard colors of CMYK are used, a combination of ink color and the number of colors is not limited to that of the present embodiment. Any one of a light color ink, a dark color ink, a specific color ink, and the like may be added to a configuration in which four color inks of CMYK are used, as needed. For example, there are also available a configuration in which a recording head for discharging a light color ink such as light cyan and light magenta is added, and a configuration in which a recording head for discharging a specific color ink such as green and orange is added. In addition, the order of placement of a recording head of each color is not particularly limited.

While there is no illustration, the four recording heads 256C, 256M, 256Y, and 256K are supported by a common head support frame. The entire head unit composed of the four recording head 256C, 256M, 256Y, and 256K, attached to the head support frame, can be moved together with the head support frame in a radial direction of the drawing barrel 252. In addition, the entire head unit of the four recording heads 256C, 256M, 256Y, and 256K can be moved together with the head support frame in an axial direction of the drawing barrel 252.

Further, while there is no illustration, each of the recording heads 256C, 256M, 256Y, and 256K is supported by a movable support mechanism that is movable in a normal direction of the nozzle face. The movable support mechanism is able to adjust a distance (gap) between the nozzle face of each of the heads and the outer peripheral surface of the drawing barrel 252, as well as change height of the head at a maintenance position for each of the heads.

During a process in which a paper sheet S is fed by the drawing barrel 252, ink is deposited on the paper sheet S from the recording heads 256C, 256M, 256Y, and 256K to record an image on the paper sheet S. Feeding a paper sheet S at a predetermined speed by using rotation of the drawing barrel 252 and performing relative movement between the paper sheet S and each of the recording heads 256C, 256M, 256Y, and 256K in the paper sheet feeding direction only once enable an image to be recorded in an image formation region in the paper sheet S. A recording method of completing an image by one scan as described above is called a single pass method.

The in-line sensor 258 is disposed downstream of the recording head 256K in the paper sheet feeding direction. The in-line sensor 258 includes an imaging element, a periphery circuit of the imaging element, and a light source. Illustration of each of the imaging element, the periphery circuit of the imaging element, and the light source, is eliminated. As the imaging element, a solid imaging element, such as a CCD image sensor and a CMOS image sensor, is available. The CCD is an abbreviation of charge coupled device. The CMOS is an abbreviation of complementary metal-oxide semiconductor.

The periphery circuit of the imaging element includes a processing circuit of an output signal of the imaging element. The processing circuit includes a filter circuit of removing a noise component from an output signal of the imaging element, an amplifier circuit, and a waveform shaping circuit, for example. Illustration of each of the filter circuit, the amplifier circuit, and the waveform shaping circuit, is eliminated.

The light source is disposed at a position from which a reading object of the in-line sensor 258 can be irradiated with illumination light. An LED, a lamp, and the like are available for the light source. The LED is an abbreviation of light emitting diode. The in-line sensor 258 corresponds to an element illustrated in FIG. 14 as the scanner 114.

A leading end of a paper sheet S delivered from the treatment liquid drying processing unit 216 to the drawing unit 218 is held by the gripper 252A of the drawing barrel 252. The paper sheet S whose leading end is held by the gripper 252A of the drawing barrel 252 is fed along the outer peripheral surface 252C of the drawing barrel 252 by rotation of the drawing barrel 252.

The paper sheet S is pressed on the outer peripheral surface 252C of the drawing barrel 252 when passing through below the paper sheet pressing roller 254. The paper sheet S passing through below the paper sheet pressing roller 254 reaches a position immediately below the recording heads 256C, 256M, 256Y, and 256K, and then an image is formed on the paper sheet S by ink discharged from each of the recording heads 256C, 256M, 256Y, and 256K.

The image formed on the paper sheet S by the recording heads 256C, 256M, 256Y, and 256K is read out by the in-line sensor 258 in a reading region of the in-line sensor 258.

The paper sheet S from which the image is read out by the in-line sensor 258 is delivered from the drawing unit 218 to the ink drying processing unit 220. It may be determined whether there is abnormal discharge from a result of image reading performed by the in-line sensor 258.

The ink drying processing unit 220 includes a chain gripper 264, an ink drying processing unit 268, and a guide plate 272. The chain gripper 264 includes a first sprocket 264A, a second sprocket 264B, a chain 264C, and a plurality of grippers 264D.

The chain gripper 264 has a structure in which a pair of endless chains 264C is stretched between a pair of the first sprockets 264A and a pair of the second sprockets 264B. FIG. 17 illustrates only one of the pair of first sprockets 264A, one of the pair of second sprockets 264B, and one of the pair of chains 264C.

The chain gripper 264 also has a structure in which the plurality of grippers 264D is disposed between the pair of chains 264C. In addition, the chain gripper 264 has a structure in which the plurality of grippers 264D is disposed at respective positions in the paper sheet feeding direction. FIG. 17 illustrates only one of the plurality of grippers 264D disposed between the pair of chains 264C.

A feeding path of a paper sheet S by using the chain gripper 264 includes a horizontal feeding region where a paper sheet S is fed along a horizontal direction, and an inclined feeding region where a paper sheet S is fed in an oblique upward direction.

The ink drying processing unit 268 is disposed above a feeding path of a paper sheet S in the chain gripper 264. A structural example of the ink drying processing unit 268 includes a structure provided with a heat source, such as a halogen heater and an infrared ray heater. Another structural example of the ink drying processing unit 268 includes a structure provided with a fan that blows air heated by the heat source to a paper sheet S. The ink drying processing unit 268 may include not only the heat source but also the fan.

While detailed illustration of the guide plate 272 is eliminated, a plate-shaped member may be used for the guide plate 272. The guide plate 272 has a length in a direction orthogonal to the paper sheet feeding direction, the length exceeding an overall length of a paper sheet S.

The guide plate 272 is disposed along a feeding path of a paper sheet S by using the chain gripper 264 in the horizontal feeding region. The guide plate 272 is disposed below the feeding path of a paper sheet S by using the chain gripper 264. The guide plate 272 has a length in the paper sheet feeding direction, the length corresponding to a length of a processing region of the ink drying processing unit 268.

The length corresponding to the length of the processing region of the ink drying processing unit 268 is a length of the guide plate 272, allowing a paper sheet S to be supported by the guide plate 272, during processing of the ink drying processing unit 268. For example, there is provided an aspect in which a length of the processing region of the ink drying processing unit 268 is equal to a length of the guide plate 272, in the paper sheet feeding direction. The guide plate 272 may include a function of absorbing and supporting a paper sheet S.

A leading end of the paper sheet S delivered from the drawing unit 218 to the ink drying processing unit 220 is held by a gripper 264D. When at least one of the first sprocket 264A and the second sprocket 264B is turned clockwise in FIG. 17 to run the chain 264C, the paper sheet S is fed along a running path of the chain 264C.

When a paper sheet S passes through the processing region of the ink drying processing unit 268, the ink drying processing unit 268 applies ink drying processing to the paper sheet S.

The paper sheet S to which the ink drying processing unit 268 applies the ink drying processing is fed to the paper ejection unit 224 by the chain gripper 264.

The chain gripper 264 feeds the paper sheet S in an oblique upper left direction in FIG. 17 on a downstream side of the ink drying processing unit 268 in the paper sheet feeding direction. In a feeding path in an inclined feeding region where the paper sheet S is fed in the oblique upper left direction in FIG. 17, a guide plate 273 is disposed. For the guide plate 273, a member similar to the guide plate 272 is available. Descriptions of a structure and a function of the guide plate 273 are eliminated.

The paper ejection unit 224 includes a paper ejection base 276. The chain gripper 264 is used for feeding of a paper sheet S in the paper ejection unit 224. The paper ejection base 276 is disposed below the feeding path of a paper sheet S by using the chain gripper 264. The paper ejection base 276 may include a lifting mechanism (not illustrated). The paper ejection base 276 can be moved up and down in accordance with increase and decrease in the number of loaded paper sheets S to maintain a paper sheet S placed at an uppermost position at a predetermined height.

The paper ejection unit 224 recovers a paper sheet S to which a series of processing of image formation is applied. When a paper sheet S reaches a position of the paper ejection base 276, the gripper 264D releases holding of the paper sheet S. The paper sheet S is then loaded on the paper ejection base 276.

While FIG. 17 illustrates the ink jet recorder 100 including the treatment liquid applying unit 214 and the treatment liquid drying processing unit 216, a form without the treatment liquid applying unit 214 and the treatment liquid drying processing unit 216 is also available.

In addition, while FIG. 17 illustrates the chain gripper 264 as a structure for feeding a paper sheet S after being drawn, another structure, such as belt-feeding and drum-feeding, may be available for feeding a paper sheet S after being drawn.

While illustration is eliminated in FIG. 17, the ink jet recorder 100 includes a maintenance unit. The maintenance unit is juxtaposed with the drawing barrel 252 in an axial direction of the rotation shaft 252B of the drawing barrel 252.

Description of Control System of Ink Jet Recorder 100

Figure 18:
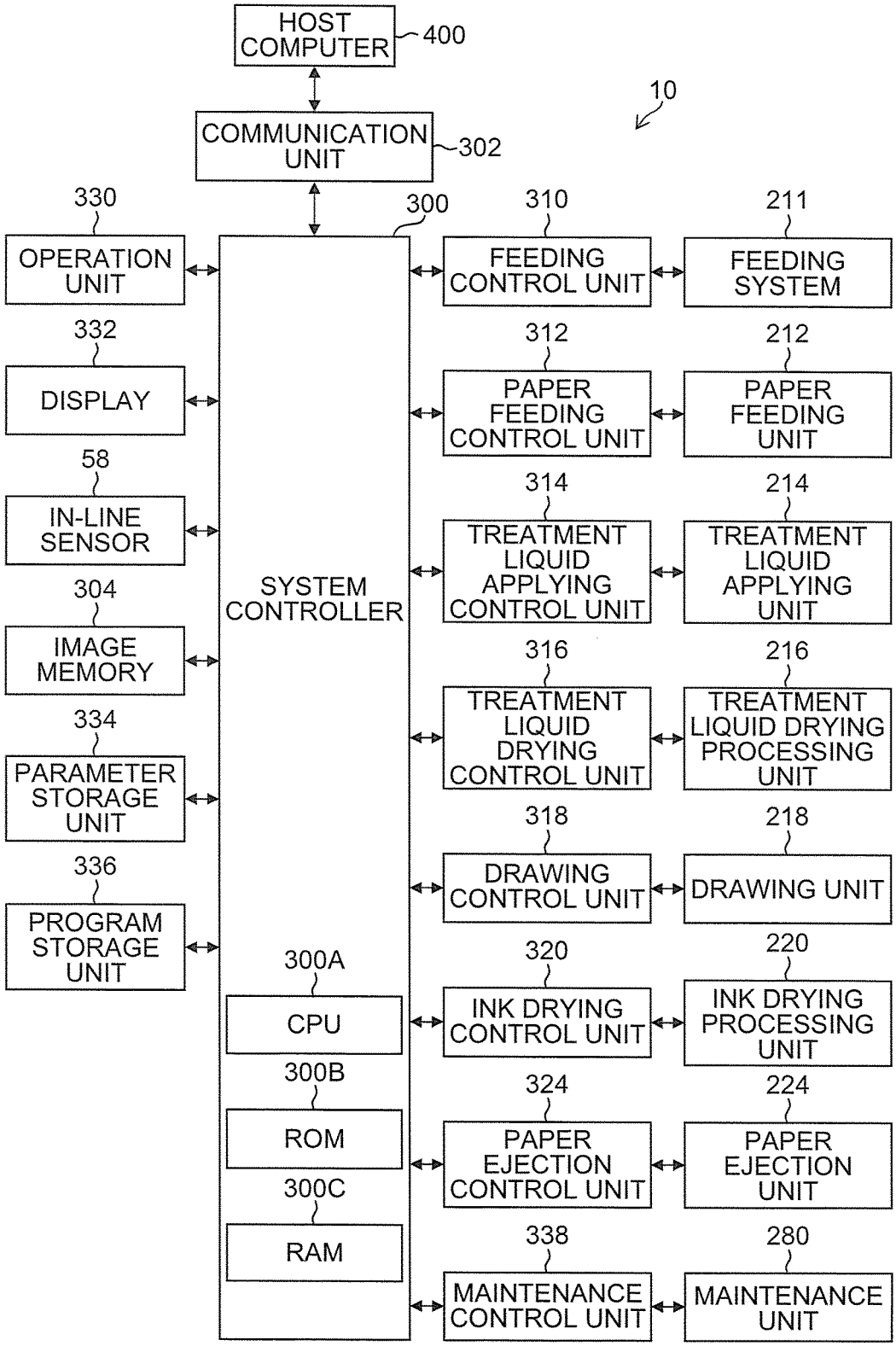
FIG. 18 is a block diagram illustrating an outline structure of a control system of the ink jet recording device.

FIG. 18 is a block diagram illustrating an outline structure of a control system of the ink jet recording device 100. The ink jet recorder 100 includes a system controller 300. The system controller 300 includes a CPU 300A, a ROM 300B, and a RAM 300C. The CPU is an abbreviation of central processing unit. The ROM is an abbreviation of read only memory. The RAM is an abbreviation of random access memory. Memory such as the ROM 300B and the RAM 300C may be provided outside the system controller 300.

The system controller 300 serves as a general control unit for integrally controlling each unit of the ink jet recorder 100. In addition, the system controller 300 serves as a calculation unit for performing various kinds of calculation processing. Further, the system controller 300 serves as a memory controller for controlling reading of data and writing of data in memory such as the ROM 300B and the RAM 300C.

The ink jet recorder 100 includes a communication unit 302, an image memory 304, a feeding control unit 310, a paper feeding control unit 312, a treatment liquid applying control unit 314, a treatment liquid drying control unit 316, a drawing control unit 318, an ink drying control unit 320, and a paper ejection control unit 324.

The communication unit 302 includes a communication interface (not illustrated), and is capable of performing transmission and reception of data with a host computer 400 connected to the communication interface.

The image memory 304 serves as a temporarily storage unit for various kinds of data including image data. Image data taken from the host computer 400 through the communication unit 302 is temporarily stored in the image memory 304.

The feeding control unit 310 controls operation of a feeding system 211 of a paper sheet S in the ink jet recorder 100. The feeding system 211 includes the treatment liquid barrel 242, the treatment liquid drying processing barrel 246, the drawing barrel 252, and the chain gripper 264, illustrated in FIG. 17.

The paper feeding control unit 312 illustrated in FIG. 18 operates the paper feeding unit 212 in response to a command from the system controller 300. The paper feeding control unit 312 controls a supply start operation of a paper sheet S and a supply stop operation of a paper sheet S, for example.

The treatment liquid applying control unit 314 operates the treatment liquid applying unit 214 in response to a command from the system controller 300. The treatment liquid applying control unit 314 controls a quantity of application of treatment liquid and timing of the application, for example.

The treatment liquid drying control unit 316 operates the treatment liquid drying processing unit 216 in response to a command from the system controller 300. The treatment liquid drying control unit 316 controls a drying temperature, a flow rate of drying gas, and injection timing of the drying gas, for example.

The drawing control unit 318 controls operation of the drawing unit 218 in response to a command from the system controller 300.

The drawing control unit 318 includes an image processing section, a waveform creation section, a waveform storage section, and a driving circuit. Illustration of the image processing section, the waveform creation section, the waveform storage section, and the driving circuit, is eliminated. The image processing section forms dot data from input image data. The waveform creation section creates a waveform of driving voltage. The waveform storage section stores the waveform of driving voltage. The driving circuit creates driving voltage with a driving waveform corresponding to dot data. The driving circuit supplies driving voltage to a liquid discharge head.

The image processing section applies the following to input image data: color separation processing of separating input image data into each color of RGB; color conversion processing of converting RGB into CMYK; correction processing, such as gamma correction and unevenness correction; and halftone processing of converting a gradation value for each color pixel into a gradation value less than an original gradation value.

The input image data includes raster data indicated by digital values from 0 to 255, for example. The dot data acquired as a result of the halftone processing may be a binary image, or a multiple value image of not less than a ternary value and less than a gradation value before the halftone processing.

Discharge timing and an amount of discharge of ink, at each pixel position, are determined on the basis of the dot data created through processing by the image processing section. Then, driving voltage in accordance with the discharge timing and the amount of discharge of ink, at each pixel position, and a control signal of determining discharge timing of the each pixel, are created. The driving voltage is supplied to the liquid discharge head, and dots are recorded with ink discharged from the liquid discharge head.

The drawing control unit 318 may include a correction processing section (not illustrated). The correction processing section performs correction processing for an abnormal nozzle. When the correction processing is performed, deterioration in image quality caused by occurrence of an abnormal nozzle is reduced.

The ink drying control unit 320 operates the ink drying processing unit 220 in response to a command from the system controller 300. The ink drying control unit 320 controls a temperature of drying gas, a flow rate of the drying gas, or injection timing of the drying gas, for example.

The paper ejection control unit 324 operates the paper ejection unit 224 in response to a command from the system controller 300. In a case where the paper ejection base 276 illustrated in FIG. 17 includes a lifting mechanism, the paper ejection control unit 324 controls operation of the lifting mechanism in accordance with increase and decrease in the number of paper sheets S.

In addition, the ink jet recorder 100 includes an operation unit 330, a display 332, a parameter storage unit 334, and a program storage unit 336.

The operation unit 330 includes an operation member such as an operation button, a keyboard, and a touch panel. The operation unit 330 may include a plurality of kinds of operation member. Illustration of the operation member is eliminated.

Information inputted through the operation unit 330 is transmitted to the system controller 300. The system controller 300 causes various kinds of processing to be performed in accordance with the information transmitted from the operation unit 330.

The display 332 includes a display device such as a liquid crystal panel, and a display driver. Illustration of the display device and the display driver is eliminated. The display 332 causes a display device to display various kinds of information, such as various kinds of setting information on devices, and abnormality information, in response to a command from the system controller 300. The operation unit 330 and the display 332 constitute a user interface.

The parameter storage unit 334 stores various parameters to be used in the ink jet recorder 100. The various parameters stored in the parameter storage unit 334 are read out through the system controller 300 to be set in each unit of the recorder.

The program storage unit 336 stores programs to be used in respective units in the ink jet recorder 100. The various programs stored in the program storage unit 336 are read out through the system controller 300 to be executed in the respective units of the recorder.

The ink jet recorder 100 includes a maintenance control unit 338. The maintenance control unit 338 controls operation of the maintenance unit 280 in response to a command from the system controller 300.

FIG. 18 illustrates respective units for each function in the ink jet recorder 100. Each of the units illustrated in FIG. 18 can be appropriately integrated, separated, shared, or eliminated. Each of the units illustrated in FIG. 18 can be configured by appropriately combining hardware and software.

The system controller 300 is able to serve as the image processing unit 122, the test pattern creation unit 124, the control unit 126, and the image analysis unit 128, illustrated in FIG. 14. In addition, the drawing control unit 318 or the system controller 300, or a combination thereof, is able to serve as the reference signal generation unit 130 and the timing adjustment unit 132, illustrated in FIG. 14. The feeding system 211 illustrated in FIG. 18 includes the feeding unit 112 illustrated in FIG. 14. The communication unit 302 illustrated in FIG. 18 is able to serve as the image input interface illustrated in FIG. 14.

Discharge timing is adjusted by using a method for adjusting a recording head, illustrated in FIGS. 12 to 16, for each of the recording heads 256C, 256M, 256Y, and 256K in the ink jet recorder 100 illustrated in FIGS. 17 and 18.

Advantages of Embodiment

The present embodiment described above has advantages as follow.

(1) According to the present embodiment, uneven concentration in a joined portion between head modules constituting a recording head can be prevented from occurring.

(2) According to the present embodiment, a recording shift of a recording head can be adjusted without adjusting an angle in a θz-direction, being an attachment angle of the recording head, and thus deviation of squareness of an image, which is a problem caused by a conventional method, is less likely to occur.

(3) The method for adjusting a recording head described in the present embodiment particularly has an effect in a case where an image is recorded on a paper sheet S in close contact with a curved face, such as a drum-feeding structure illustrated in FIG. 17.

(4) Since the present embodiment does not need to provide a structure for adjusting discharge timing for each of nozzle arrays different in position in the Y-direction, uneven concentration of a recording head can be prevented by a structure for relatively adjusting discharge timing in units of head module. Thus, reduction in uneven concentration can be achieved with a simple structure as compared with a system configuration in which discharge timing is adjusted for each nozzle array.

Variation 1

While FIG. 6 illustrates a nozzle array in which a paper feeding side nozzle group at 600 dpi and a paper ejection side nozzle group at 600 dpi are disposed away from each other in the Y-direction, a placement of the nozzle groups is not limited to that in which the paper feeding side nozzle group and the paper ejection side nozzle group are away from each other in the Y-direction, when the invention is practiced. Even in a nozzle array of a single nozzle group, it can be relatively divided into a paper feeding side nozzle and a paper ejection side nozzle. For example, in a nozzle array of a two dimensional matrix, a nozzle disposed in a region on a paper feeding side, being a proximal side in the paper sheet feeding direction, can serve as a paper feeding side nozzle, and a nozzle disposed in a region on a paper ejection side, being a back side in the paper sheet feeding direction, can serve as a paper ejection side nozzle.

Variation 2

While an example in which discharge timing is adjusted so that a recording shift amount in a complementary region in adjacent head modules becomes an average value of a first non-complementary region recording shift amount and a second non-complementary region recording shift amount in the embodiment described above, a form of adjusting discharge timing is not limited to that in which discharge timing is adjusted so that a recording shift amount in the complementary region becomes an average value of the first non-complementary region recording shift amount and the second non-complementary region recording shift amount, when the invention is practiced. There is also available a form in which discharge timing is adjusted so that a recording shift amount in a complementary region in adjacent head modules becomes an appropriate value between the first non-complementary region recording shift amount and the second non-complementary region recording shift amount.

In addition, in a case where the first non-complementary region recording shift amount and the second non-complementary region recording shift amount in adjacent head modules are equal to each other, or where a difference between the recording shift amounts is very small, discharge timing may be adjusted so that a recording shift amount in a complementary region in a joined portion becomes equal to either the first non-complementary region recording shift amount or the second non-complementary region recording shift amount.

Variation 3

The performing order of the first measurement step at step S16 and the second measurement step at step S17 illustrated in FIG. 15 is not limited to an example illustrated in FIG. 15, and the order can be changed. The first measurement step at step S16 and the second measurement step at step S17 may be processed in parallel.

In addition, in the second measurement step at step S17, a step of measuring the first non-complementary region recording shift amount of the first head module and a step of measuring the second non-complementary region recording shift amount of the second head module may be performed at different timing.

Each of a step of measuring the complementary region recording shift amount, a step of measuring the first non-complementary region recording shift amount, and a step of measuring the second non-complementary region recording shift amount of the second head module, can be performed at appropriate timing within a range where advantageous effects of the invention can be acquired.

Variation 4

While, in the embodiment described above, there is illustrated a recording head in which a head module having a nozzle region where a plurality of nozzles are arranged to form a two-dimensional array, the nozzle region being in the shape of a parallelogram in plan view, is arranged in a row in the X-direction, an array form of head modules in the recording head is not limited to the form in which a plurality of head modules is aligned along the X-direction, and there is available a form in which a plurality of head modules are arranged along the X-direction in a zigzag manner. In addition, there is also available a head module with a nozzle region in the shape of a trapezoid or a rectangle in plan view.

Regarding Discharge System

A device for generating discharge energy for a discharge system of the head module 12 is not limited to a piezoelectric element, and various discharge energy generation elements, such as a heat generation element and an electrostatic actuator, are available. For example, there is available a system in which a droplet is discharged by using pressure caused by film boiling of liquid heated by a heat generation element. Depending on a discharge system of a liquid discharge head, a corresponding discharge energy generation element is provided in a flow channel structure.

Regarding Device for Feeding Paper Sheet

A device for feeding a paper sheet S is not limited to the drum-feeding mechanism illustrated in FIG. 17, and there are available various forms, such as a belt feeding mechanism, a nip feeding mechanism, a chain feeding mechanism, and a pallet feeding mechanism, and also these mechanisms can be appropriately combined.

Regarding Device for Reading Image

As a device for reading out recorded results of a first test chart, a second test chart, and a third test chart, each of which is a chart for measurement to be used for measuring a recording shift amount, a scanner separated from the ink jet recorder 100 is available instead of the in-line sensor 258. As the separated scanner, for example, there is available a scanner of a flat bed type so-called an off-line scanner that is available off-line.

Regarding Combination of Examples of Control or the Like

The structure described in the embodiment above and the matters described in the variations can be appropriately combined to be used, and some of the matters also can be substituted.

Regarding Terms

The term "orthogonal" or "vertical" in the present specification includes an aspect having an operation effect similar to that in a case of an intersection at an angle of a substantially 90°, in an aspect of an intersection at an angle less than 90°, or an angle exceeding 90°.

The term "parallel" in the present specification includes a substantially parallel state where even if two directions intersect with each other, an operation effect equivalent to that in a parallel state is achieved. That is, the term "parallel" includes an allowable range in which even a strictly non-parallel state can be deemed substantially parallel.

The term "barrel" in the present specification is synonymous with a "drum". The drum is a feeding member with a cylindrical shape, and holds at least a part of a medium. The feeding member is turned around a center axis of the cylindrical shape to feed the medium along an outer peripheral surface of the cylindrical shape.

The term "paper sheet" used in the present specification is synonymous with a "medium" to which liquid discharged from a recording head is to be attached. The "paper sheet" is synonymous with terms, such as a recording medium, a print sheet, a recording paper sheet, a printing medium, a medium to be printed, a medium to be recorded, an image formation medium, an image formed medium, a medium receiving an image, and a medium to be discharged. The medium is not particularly limited in material, shape, and the like, and a resin sheet, a film, a cloth, a nonwoven cloth, and another material, are available other than paper material, and also various forms, such as a continuous paper sheet, a cut paper sheet (cut-sheet paper), and a seal paper sheet, are available.

The term "image" is broadly interpreted, and includes a color image, a black-and-white image, a single color image, a gradation image, a uniform concentration (solid) image, and the like. The "image" is not limited to a photographic image, and is used as a comprehensive term including a pattern, a character, a mark, a line drawing, a mosaic pattern, a pattern formed with different colors, a line pattern, and other various patterns, or an appropriate combination thereof. The term "recording" includes concepts of terms, such as printing, a printed letter, formation of an image, drawing, and a print.

The term "recorder" is synonymous with terms such as a printing device, a printing machine, a printer, an image recorder, and a drawing device. The recorder is included in a concept of an "image forming apparatus".

The term "recording head" can be understood by being substituted with the term "liquid discharge head" or "ink jet head".

Example of Application to Another Apparatus

While an example of application to an ink jet recorder for graphic printing has been described in the embodiment described above, the scope of application of the present invention is not limited to the example. For example, the present invention can be widely used for an image forming apparatus that can form various shapes and patterns by using functional liquid material, such as a wiring drawing apparatus for drawing a wiring pattern of an electronic circuit, a manufacturing apparatus for various devices, a resist printer that uses resin liquid as a functional liquid for discharge, a color filter manufacturing apparatus, and a fine structure forming apparatus that forms a fine structure by using a material for material deposition.

In the embodiment of the present invention described above, constituent features can be appropriately modified, added, and eliminated within a range without departing from the spirit of the present invention. The present invention is not limited to the embodiments described above, and a person with ordinary skill in the field can make many modifications within a technical idea of the present invention.

What is claimed is:

1. A method for adjusting a recording head that is a method for adjusting discharge timing of a plurality of head modules in the recording head formed by joining the plurality of head modules each of which has a nozzle array in which a plurality of nozzles for discharging droplets are arranged at different positions in a first direction, wherein the plurality of head modules are joined in a second direction intersecting with the first direction, the recording head including a complementary region where a nozzle belonging to one of the head modules adjacent to each other in the second direction and a nozzle belonging to the other of the head modules complement each other to record a dot row aligned in the second direction, the method comprising:

a first measurement step of measuring a complementary region recording shift amount that is a recording shift amount in the first direction in the complementary region in a joined portion between a first head module and a second head module that are the head modules adjacent to each other;

a second measurement step of measuring a first non-complementary region recording shift amount that is a recording shift amount in the first direction in a non-complementary region other than the complementary region in a nozzle array in the first head module, and a second non-complementary region recording shift amount that is a recording shift amount in the first direction in a non-complementary region other than the complementary region in a nozzle array in the second head module; and a timing adjustment step of adjusting discharge timing of at least one of the first head module and the second head module according to the complementary region recording shift amount that is measured in the first measurement step, and the first non-complementary region recording shift amount and the second non-complementary region recording shift amount that are measured in the second measurement step, wherein adjustment is performed in the timing adjustment step so that the complementary region recording shift amount after being adjusted becomes a value between the first non-complementary region recording shift amount and the second non-complementary region recording shift amount.

2. The method for adjusting a recording head according to claim 1, wherein adjustment is performed in the timing adjustment step so that the complementary region recording shift amount after being adjusted becomes an average value of the first non-complementary region recording shift amount and the second non-complementary region recording shift amount.

3. The method for adjusting a recording head according to claim 1, wherein the complementary region becomes an array form in which projection nozzles belonging to the first head module and projection nozzles belonging to the second head module are interleaved in a projected nozzle array in which the projection nozzles align along the second direction, wherein the projection nozzles are acquired by projecting each of nozzles of the first head module and the second head module on a straight line along the second direction.

4. The method for adjusting a recording head according to claim 1, wherein the first non-complementary region recording shift amount is measured at a position closer to the second head module than a center position of the first head module in the second direction in the non-complementary region of the first head module, and the second non-complementary region recording shift amount is measured at a position closer to the first head module than a center position of the second head module in the second direction in the non-complementary region of the second head module.

5. The method for adjusting a recording head according to claim 1, further comprising a calculation step of calculating an adjustment value of the discharge timing according to the complementary region recording shift amount that is measured in the first measurement step, and the first non-complementary region recording shift amount and the second non-complementary region recording shift amount that are measured in the second measurement step.

6. The method for adjusting a recording head according to claim 1, wherein the first non-complementary region recording shift amount is acquired by measuring an amount of displacement of a recording position of each of nozzles as far as possible from each other in the first direction, in nozzles in proximity to each other in the second direction in a nozzle range in the second direction, with a width equivalent to a complementary region width that is a width of the complementary region in the second direction, in nozzles belonging to the non-complementary region of the first head module, and the second non-complementary region recording shift amount is acquired by measuring an amount of displacement of a recording position of each of nozzles as far as possible from each other in the first direction, in nozzles in proximity to each other in the second direction in a nozzle range in the second direction, with a width equivalent to the complementary region width, in nozzles belonging to the non-complementary region of the second head module.

7. The method for adjusting a recording head according to claim 1, wherein the first direction is a feeding direction of a recording medium, and the recording head is a line head.

8. The method for adjusting a recording head according to claim 1, wherein the head module includes a nozzle region where a plurality of nozzles are arranged to form a two-dimensional array, the nozzle region being in a shape of a parallelogram in plan view, and the recording head is a line head formed by aligning the plurality of head modules each including the nozzle region in the shape of a parallelogram in plan view, in the second direction.

9. The method for adjusting a recording head according to claim 1, further comprising a feeding step of feeding a recording medium by bringing a recording medium into close contact with a curved face, wherein a droplet is discharged from the nozzle to the recording medium in close contact with the curved face.

10. The method for adjusting a recording head according to claim 1, further comprising:

a first test pattern recording step of recording a first test pattern to be used to measure the complementary region recording shift amount on a recording medium with the first head module and the second head module;

a second test pattern recording step of recording a second test pattern to be used to measure the first non-complementary region recording shift amount on a recording medium with the first head module and the second head module; and a third test pattern recording step of recording a third test pattern to be used to measure the second non-complementary region recording shift amount on a recording medium with the first head module and the second head module.

11. The method for adjusting a recording head according to claim 10, wherein a pattern equivalent to the first test pattern is used for each of the second test pattern and the third test pattern, and the first non-complementary region recording shift amount and the second non-complementary region recording shift amount are measured by a measurement method equivalent to a measurement method of the complementary region recording shift amount.

12. The method for adjusting a recording head according to claim 10, further comprising a reading step of creating readout data on each of test patterns by reading out a recorded result of each of the test patterns of the first test pattern, the second test pattern, and the third test pattern, wherein the complementary region recording shift amount, the first non-complementary region recording shift amount, and the second non-complementary region recording shift amount are measured according to the readout data.

13. An image forming apparatus comprising:

a recording head formed by joining a plurality of head modules each of which has a nozzle array in which a plurality of nozzles for discharging droplets are arranged at different positions in a first direction, the head modules being joined in a second direction intersecting with the first direction, the recording head including a complementary region where a nozzle belonging to one of the head modules adjacent to each other in the second direction and a nozzle belonging to the other of the head modules complement each other to record a dot row aligned in the second direction;

a first measurement unit that measures a complementary region recording shift amount that is a recording shift amount in the first direction in the complementary region in a joined portion between a first head module and a second head module that are the head modules adjacent to each other;

a second measurement unit that measures a first non-complementary region recording shift that is a recording shift amount in the second direction in a non-complementary region other than the complementary region in a nozzle array in the first head module, and a second non-complementary region recording shift amount that is a recording shift amount in the first direction in a non-complementary region other than the complementary region in a nozzle array in the second head module; and a timing adjustment unit that adjusts discharge timing of at least one of the first head module and the second head module according to the complementary region recording shift amount that is measured by the first measurement unit, and the first non-complementary region recording shift amount and the second non-complementary region recording shift amount that are measured by the second measurement unit, wherein the timing adjustment unit performs adjustment so that the complementary region recording shift amount after being adjusted becomes a value between the first non-complementary region recording shift amount and the second non-complementary region recording shift amount.

14. The image forming apparatus according to claim 13, wherein the image forming apparatus comprises a plurality of recording heads.

* * * * *